US008910352B2

(12) United States Patent
Nozaki et al.

(10) Patent No.: US 8,910,352 B2
(45) Date of Patent: Dec. 16, 2014

(54) SLIDE FASTENER

(75) Inventors: Jiro Nozaki, Toyama (JP); Kenji Yuki, Toyama (JP); Kiyomasa Segawa, Toyama (JP); Hideki Sato, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/702,104

(22) PCT Filed: Jun. 23, 2010

(86) PCT No.: PCT/JP2010/060653

§ 371 (c)(1),
(2), (4) Date: Dec. 5, 2012

(87) PCT Pub. No.: WO2011/161784

PCT Pub. Date: Dec. 29, 2011

(65) Prior Publication Data

US 2013/0074292 A1 Mar. 28, 2013

(51) Int. Cl.
*A44B 19/26* (2006.01)
*A44B 19/38* (2006.01)

(52) U.S. Cl.
CPC ..... *A44B 19/26* (2013.01); *A44B 19/38* (2013.01)
USPC ..... 24/433; 24/415

(58) Field of Classification Search
CPC ..... A44B 19/26; A44B 19/38; A44B 19/388
USPC ..... 24/433, 434, 415
See application file for complete search history.

(56) References Cited

U.S. PATENT DOCUMENTS

| | | | | | |
|---|---|---|---|---|---|
| 4,152,813 | A | * | 5/1979 | Heimberger | 24/434 |
| 4,221,026 | A | | 9/1980 | Kanzaka | |
| 4,742,603 | A | | 5/1988 | Kasai | |
| 4,942,648 | A | * | 7/1990 | Yoshida | 24/389 |
| 5,586,370 | A | * | 12/1996 | Fudaki | 24/433 |
| 5,755,014 | A | * | 5/1998 | Yamaguchi et al. | 24/433 |
| 6,112,376 | A | * | 9/2000 | Akashi et al. | 24/433 |

(Continued)

FOREIGN PATENT DOCUMENTS

| | | | |
|---|---|---|---|
| CN | 101152030 | A | 4/2008 |
| DE | 2924026 | A | 1/1980 |

(Continued)

OTHER PUBLICATIONS

International Search Report, PCT Application No. PCT/JP2010/060653, mailed Oct. 12, 2010.

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A slide fastener includes a pair of first and second separable interfitting parts fixed to first and second fastener stringers. The first separable interfitting part includes a slider-holding part, and the second separable interfitting part is configured to be insertable/removable into/from the slider held on the slider-holding part through the tape insertion gap. A protruding part is arranged at a front end of the second separable interfitting part. A width dimension A of the protruding part, a dimension B between a back end of a side surface of the protruding part and an opposed end on a side opposite to the first separable interfitting part, and a dimension C between a guide post and a flange of the slider have a relationship of A<C<B.

2 Claims, 17 Drawing Sheets

(56) References Cited

U.S. PATENT DOCUMENTS

| | | | | |
|---|---|---|---|---|
| 6,195,852 | B1 * | 3/2001 | Kusayama | 24/434 |
| 6,421,887 | B1 * | 7/2002 | Oda et al. | 24/433 |
| 6,481,068 | B1 * | 11/2002 | Takasawa | 24/433 |
| 6,704,975 | B2 * | 3/2004 | Matsumoto et al. | 24/434 |
| 7,210,202 | B2 * | 5/2007 | Hamada | 24/433 |
| 7,415,753 | B2 * | 8/2008 | Kusayama et al. | 24/386 |
| 7,500,291 | B2 * | 3/2009 | Matsumoto | 24/389 |
| 2003/0213107 | A1 * | 11/2003 | Mizuhara et al. | 24/433 |
| 2004/0181919 | A1 * | 9/2004 | Mizuhara et al. | 24/387 |
| 2004/0181920 | A1 * | 9/2004 | Mizuhara et al. | 24/387 |
| 2008/0040901 | A1 | 2/2008 | Himi | |
| 2012/0167354 | A1 * | 7/2012 | Keyaki et al. | 24/386 |
| 2012/0260468 | A1 * | 10/2012 | Nozaki et al. | 24/386 |

FOREIGN PATENT DOCUMENTS

| | | | |
|---|---|---|---|
| EP | 206344 | A2 | 12/1986 |
| EP | 1889552 | A2 | 2/2008 |
| FR | 2431843 | A | 2/1980 |
| GB | 2024928 | A | 1/1980 |
| GB | 2178479 | A | 2/1987 |
| HK | 1116637 | A1 | 4/2010 |
| JP | 59-25227 | Y2 | 7/1984 |
| JP | 2-16650 | Y2 | 5/1990 |
| JP | 6-30012 | Y2 | 8/1994 |
| JP | 2008-43568 | A | 2/2008 |
| KR | 10-2008-0016477 | A | 2/2008 |
| WO | 2009/153885 | A1 | 12/2009 |
| WO | 2010/041303 | A1 | 4/2010 |

* cited by examiner

SLIDE FASTENER

This application is a national stage application of PCT/JP2010/060653 which is incorporated herein by reference.

TECHNICAL FIELD

The invention relates to a slide fastener having a first separable interfitting part provided in one first fastener stringer, a second separable interfitting part provided in another second fastener stringer, and a slider slidably attached along an element row of the first fastener stringer and capable of performing a separable interfitting operation by inserting/withdrawing the second separable interfitting part into/from the slider held on a slider-holding part of the first separable interfitting part.

BACKGROUND ART

A slider fastener capable of performing separable interfitting operation of the slider fastener by two kinds of operation to improve ease of use of a separable bottom end stop of the slider fastener is disclosed in Japanese Patent Application Laid-Open No. 2008-43568 (Patent Document 1).

A slider fastener 101 described in Patent Document 1 includes, as shown in FIGS. 18 to 20, a pair of first and second fastener stringers 106*a*, 106*b* having an element row 104 formed at a tape-side edge of right and left fastener tapes 102, a pair of first and second separable interfitting parts 110, 120 fixed to one end of the element row 104 in the first and second fastener stringers 106*a*, 106*b*, and a slider 130 slidably arranged along the element row 104.

The slider 130 includes an upper blade, a lower blade, a guide post 131 connecting the upper and lower blades, upper and lower flanges 132 arranged at a right and left side edge of the upper and lower blades, and a tab (not shown) attached to the upper blade. The slider 130 also has a posterior orifice arranged on a back end side and right and left shoulders arranged on both sides of the guide post 131. Further, an element guide passage 133 in a substantially Y shape communicatively connecting the right and left shoulders and the posterior orifice is formed between the upper and lower blades.

The first separable interfitting part 110 includes a slider-holding part 111 formed on front and back surfaces of the one (right) fastener tape 102, a thick pivotal stopping part 112 extended backward from the slider-holding part 111, a reinforcing part 113 formed on the tape inner side from the slider-holding part 111, and a concave groove 114 arranged on the side opposite to the second separable interfitting part 120.

The pivotal stopping part 112 extends from the back end of the slider-holding part 111 to the back end of tape and is formed in a curved shape from the back end of the tape toward the second separable interfitting part 120. Thus, the pivotal stopping part 112 has a substantially J shape in the front view. The pivotal stopping part 112 includes a pivotal movement space 115 whose front side is open so that a pivotal stopped part 122 described later of the second separable interfitting part 120 can be fitted and an inner circumferential surface 116 that freely rotatingly engages the pivotal stopped part 122 fitted into the pivotal movement space 115. Further, the pivotal stopping part 112 has a slit 117 cut through from the inner circumferential surface 116 of the pivotal stopping part 112 to an outer circumferential surface of the pivotal stopping part 112 formed in a tip portion of the pivotal stopping part 112.

The second separable interfitting part 120 includes a fitting plate 121 in a thin-plate shape integrally formed on front and back surfaces of the other (left) fastener tape 102, the pivotal stopped part 122 formed at the back end of the fitting plate 121, a projected rim 123 formed along an edge on the tape inner side of the fitting plate 121, a protruding part 124 formed at the front end of the fitting plate 121 continuously from the element row 104, and a dent 125 formed on the front surface and the back surface of the fitting plate 121.

In the second separable interfitting part 120, the fitting plate 121 is formed flat and the thickness in the tape front and back direction is formed smaller than an interval of a tape insertion gap (also called a tape groove) provided between upper and lower flange portions 132 of the slider 130. The fitting plate 121 is also provided with a notch portion 126 cut forward from the back end of tape. The pivotal stopped part 122 is formed cylindrically at the back end of the fitting plate 121 and the thickness dimension in the tape front and back direction of the pivotal stopped part 122 is formed smaller than the interval between the upper blade and the lower blade of the slider 130.

In the slide fastener 101 of Patent Document 1 having the above configuration, an engaging operation to engage the second separable interfitting part 120 into the first separable interfitting part 110 can arbitrarily be selected from two operations shown below when the first and second fastener stringers 106*a*, 106*b* on the right and left are closed.

First, as a first engaging operation, an operation to cause the pivotal stopped part 122 of the second separable interfitting part 120 to engage with the first separable interfitting part 110 by inserting from the side of the first separable interfitting part 110 without passing through an element guide passage 133 of the slider 130 will be described.

When the first engaging operation is performed, first the slider 130 is slid toward the first separable interfitting part 110 to hold the slider 130 on the slider-holding part 111. Next, as shown in FIG. 19, the pivotal stopped part 122 of the second separable interfitting part 120 is inserted into the pivotal movement space 115 through a gap formed between the pivotal stopping part 112 of the first separable interfitting part 110 and the slider 130 and further the pivotal stopped part 122 is caused to touch the inner circumferential surface 116 of the pivotal stopping part 112. Accordingly, the second separable interfitting part 120 can be caused to engage with the first separable interfitting part 110.

Subsequently, the second separable interfitting part 120 is rotated around the pivotal stopped part 122 toward the first separable interfitting part 110 to insert the fitting plate 121 of the second separable interfitting part 120 into the element guide passage 133 through the tape insertion gap of the slider 130. Accordingly, the right and left element rows 104 are positioned for stable interlocking.

Then, the slider 130 is slid upward while the fitting plate 121 is inserted through the element guide passage 133 of the slider 130. Accordingly, the fitting plate 121 of the second separable interfitting part 120 is fitted into the concave groove 114 of the first separable interfitting part 110 and also the slide fastener 101 can be caused to close by causing the right and left element rows 104 to interlock.

Next, as a second engaging operation, an operation to cause the pivotal stopped part 122 of the second separable interfitting part 120 to engage with the first separable interfitting part 110 by inserting into the pivotal movement space 115 of the first separable interfitting part 110 through the element guide passage 133 of the slider 130 will briefly be described.

When the second engaging operation is performed, first, like in the first engaging operation, the slider 130 is slid toward the first separable interfitting part 110 hold the slider 130 on the slider-holding part 111. Next, as shown in FIG. 20, the pivotal stopped part 122 of the second separable interfitting part 120 is inserted from the shoulder of the slider 130. Accordingly, the pivotal stopped part 122 of the second separable interfitting part 120 is inserted into the pivotal movement space 115 of the first separable interfitting part 110 by passing through the element guide passage 133 of the slider 130 and further engaged with the pivotal stopping part 112 by touching the inner circumferential surface 116 of the pivotal stopping part 112.

Accordingly, the right and left element rows 104 are positioned for stable interlocking. Then, like the first engaging operation, the slide fastener 101 can be caused to close by sliding the slider 130 upward while the fitting plate 121 is inserted through the element guide passage 133 of the slider 130.

According to Patent Document 1, when the closed slide fastener 101 is separated, the slider 130 is slid toward the first separable interfitting part 110 to cause the slider-holding part 111 to hold the slider 130. Subsequently, the pivotal stopped part 122 of the second separable interfitting part 120 engaged with the pivotal stopping part 112 is removed by passing through a gap formed between the first separable interfitting part 110 and the slider 130 or by passing through the element guide passage 133 of the slider 130. Accordingly, the first and second fastener stringers 106*a*, 106*b* on the right and left can be separated.

The slide fastener 101 according to Patent Document 1 has, as described above, a structure in which two different operations of the first engaging operation and the second engaging operation described above can be performed and thus, the user of the slide fastener 101 can arbitrarily adopt one of the engaging operations to close the slide fastener 101. Therefore, the slide fastener 101 excels in operability of the separable interfitting operation and has an advantage that anyone can use the slide fastener 101 easily.

PRIOR ART DOCUMENT

Patent Document

Patent Document 1: Japanese Patent Application Laid-Open No. 2008-43568

SUMMARY OF THE INVENTION

Problems to be Solved by the Invention

The slide fastener 101 capable of performing two different separable interfitting operations as described in Patent Document 1 can cause, as described above, the right and left element rows 104 to interlock smoothly by moving the slider 130 in a fastener closing direction in a state in which the second separable interfitting part 120 is held in a normal position by causing the pivotal stopping part 112 of the first separable interfitting part 110 to engage with the pivotal stopped part 122 of the second separable interfitting part 120.

On the other hand, if the user of the slide fastener does not notice that the second separable interfitting part 120 is not engaged in a normal position, even if the second separable interfitting part 120 is not engaged in a predetermined normal position with respect to the first separable interfitting part 110, the user may have erroneously operated and moved the slider 130 in the fastener closing direction.

More specifically, if, for example, the protruding part 124 of the second separable interfitting part 120 is inserted through the element guide passage 133 of the slider 130 even if the pivotal stopped part 122 of the second separable interfitting part 120 is not fitted into the pivotal stopping part 112 of the first separable interfitting part 110, the user may have erroneously moved the slider 130 in the fastener closing direction.

In such a case, according to the slide fastener 101 in Patent Document 1, the slider 130 easily moves in the fastener closing direction even if the pivotal stopped part 122 of the second separable interfitting part 120 is not engaged with the pivotal stopping part 112 of the first separable interfitting part 110, the right and left element rows 104 may have invalidly interlocked to cause the slide fastener 101 to close.

However, even if the slide fastener 101 is closed while the pivotal stopped part 122 is not engaged with the pivotal stopping part 112 as described above, when a horizontal pulling force is given to the slide fastener 101 in a direction in which the first and second fastener stringers 106*a*, 106*b* are pulled apart, the horizontal pulling force cannot be withstood between the first separable interfitting part 110 and the second separable interfitting part 120 because the first and second separable interfitting parts 110, 120 are separated from each other. Therefore, the right and left element rows 104 in an interlocking state are easily separated from the end on the side of the first and second separable interfitting parts 110, 120, posing a problem of causing a failure of the slide fastener 101.

Further, when the slider 130 is slid in a fastener closing direction while the pivotal stopped part 122 is not engaged with the pivotal stopping part 112, the relative position between the protruding part 124 of the second separable interfitting part 120 and fastener elements of the first fastener stringer 106*a* is not aligned and thus, the physical relationship between both parts is frequently shifted.

If the positions of the protruding part 124 and fastener elements of the first fastener stringer 106*a* are shifted as described above, the protruding part 124 and the fastener elements of the first fastener stringer 106*a* do not interlock properly, but some users slide the slider 130 by force, damaging the first and second separable interfitting parts 110, 120 or the fastener elements.

The invention is made in view the above conventional problems and a concrete object thereof is to provide a slide fastener that does not fail or is not damaged due to position shifts of first and second separable interfitting parts even if an attempt is made to slide a slider when the second separable interfitting part is not engaged in a normal position with respect to the first separable interfitting part because interlocking of element rows is prevented.

Means for Solving the Problems

To achieve the above object, a slide fastener provided by the invention is a slide fastener having, as a basic configuration, a pair of first and second fastener stringers in which an element row is formed in right and left fastener tapes, a pair of first and second separable interfitting parts fixed to one end of each of the element rows in the first and second fastener stringers, and a slider slidably attached along the element row of the first fastener stringer, wherein the slider includes a guide post, upper and lower blades connected to the guide post, a flange arranged at right and left side edges of at least one of the upper and lower blades, and a tape insertion gap formed at right and left side edges of the slider, the first separable interfitting part includes a slider-holding part that holds the slider on a sliding end, and the second separable interfitting part is configured to be insertable/removable into/from the slider held on the slider-holding part in a tape width direction through the tape insertion gap, wherein the second separable interfitting part includes a body part in a thin-plate shape fixed to the fastener tape and a protruding part arranged at an end on a side of the element row of the body part and formed thicker than the body part, the protruding part includes an opposed end arranged on the side opposite to the first separable interfitting part and a side surface arranged on the opposite side to the side opposite to the first separable interfitting part, and if a dimension of the protruding part in the tape width direction is defined as a first dimension A, a dimension between a back end on the opposite side of the side of the element row on the side surface of the protruding part and the opposed end on the side opposite to the first separable interfitting part is defined as a second dimension B, and a dimension equal to an interval between the guide post and the flange in an element guide passage on a shoulder side of the slider is defined as a third dimension C, the protruding part has a relationship of the first dimension A<the third dimension C<the second dimension B.

In the slide fastener according to the invention, the back end of the side surface is preferably arranged in a position on a backward side from the opposed end in a tape length direction and an inclined surface is preferably arranged between the back end of the side surface and the opposed end.

Also in the slide fastener according to the invention, when the slider is held on the slider-holding part and the second separable interfitting part is held in an abnormal position with respect to the first separable interfitting part, the opposed end and the side surface of the protruding part are preferably in contact with the guide post and the flange of the slider respectively.

On the other hand, when the slider is held on the slider-holding part and the second separable interfitting part is held in a normal position with respect to the first separable interfitting part, the protruding part is preferably in contact with the guide post or the flange of the slider.

Further, in the slide fastener according to the invention, it is preferable that the slider-holding part includes a swelling portion protruding to the opposite side to the side opposite to the second separable interfitting part.

Effect of the Invention

A slide fastener according to the invention has a pair of first and second separable interfitting parts fixed to one end of an element row of first and second fastener stringers and the first separable interfitting part includes a slider-holding part that holds a slider on a sliding end.

The second separable interfitting part includes a body part in a thin-plate shape fixed to a fastener tape and a protruding part arranged at an end (front end) on a side of the element row of the body part and formed thicker than the body part in the tape front and back direction, and the protruding part includes an opposed end arranged on the side opposite to the first separable interfitting part and a side surface on a tape inner side arranged on the opposite side to the side opposite to the first separable interfitting part. When an opposed-side surface substantially parallel to the tape length direction is arranged on the side opposite to the first separable interfitting part, the opposed end of the protruding part refers to an end (corner) on the side of the element row on the opposed-side surface.

Further, in the slide fastener according to the invention, when the dimension of the protruding part in the tape width direction is defined as a first dimension A, the dimension between the back end and the opposed end of the side surface on the tape inner side in the protruding part is defined as a second dimension B, and the dimension equal to the interval between a guide post and a flange in an element guide passage on the a shoulder side of the slider is defined as a third dimension C, the protruding part is configured to have a relationship of first dimension A<third dimension C<second dimension B.

In the slide fastener of the invention in which the protruding part as described above is arranged in the second separable interfitting part, the second dimension B of the protruding part is set larger than the third dimension C of the slider and thus, when the second separable interfitting part is engaged in a position (abnormal position) deviating from the normal position with respect to the first separable interfitting part, the slide fastener is configured so that the protruding part is caught by the guide post and the flange of the slider.

Accordingly, even if an attempt is made to slide the slider when the second separable interfitting part is held in an abnormal position as described above, the protruding part is caught by the slider to prevent the slider from sliding. As a result, the user cannot move the slider in the fastener closing direction even if the slider is erroneously operated in a state in which the second separable interfitting part is held in an abnormal position and therefore, incorrect interlocking of right and left element rows as in the past can reliably be prevented.

That is, the slide fastener in the invention is configured to be unable to interlock the right and left element rows when the second separable interfitting part is engaged by deviating from the normal position with respect to the first separable interfitting part. Thus, an occurrence of conventional problems, for example, incorrectly interlocked right and left element rows are easily separated after being subjected to a horizontal pulling force or the first and second separable interfitting parts and the fastener elements are damaged after the slider being pulled by force can be prevented.

On the other hand, the first dimension A of the protruding part is set smaller than the third dimension C of the slider in the slide fastener of the invention and thus, when the second separable interfitting part is engaged in a normal position with respect to the first separable interfitting part, the slide. fastener is configured so that the protruding part can smoothly be inserted between the guide post and the flange of the slider. Accordingly, by sliding the slider in the closing direction when the second separable interfitting part is engaged in the normal position, the slide fastener can be closed with stability by interlocking the right and left element rows smoothly and properly.

In the slide fastener of the invention, the back end on the side surface of the protruding part is arranged in a position on a backward side from the opposed end in the tape length direction and an inclined surface is arranged between the back end of the side surface and the opposed end. Accordingly, when, for example, the second separable interfitting part is inserted into the slider held on the slider-holding part of the first separable interfitting part in the tape width direction through the tape insertion gap, the protruding part can smoothly be introduced into the element guide passage of the slider by using the inclined surface arranged in the protruding part.

When the protruding part is introduced into the element guide passage of the slider, the back end of the protruding part can be brought into contact with the flange of the slider with stability and thus, a state in which the second separable interfitting part is engaged with the first separable interfitting part can be maintained with stability. Further, with the side surface of the protruding part being formed long to the backward side, the protruding part moves relatively to posterior orifice side of the slider and also the element row of the second fastener stringer subsequent to the protruding part can smoothly be inserted into the element guide passage of the slider by sliding the slider in the closing direction while the second separable interfitting part is engaged in the normal position.

When the slider is held by the slider-holding part and the second separable interfitting part is held in an abnormal position with respect to the first separable interfitting part, the slide fastener in the invention is configured so that the opposed end and the side surface on the tape inner side of the protruding part are in contact with the guide post and the flange of the slider respectively. Accordingly, when the second separable interfitting part is held in an abnormal position, the protruding part can reliably be caught by the guide post and the flange of the slider and therefore, incorrect interlocking of the right and left element rows can reliably be prevented.

On the other hand, when the slider is held by the slider-holding part and the second separable interfitting part is held in a normal position with respect to the first separable interfitting part, the slide fastener in the invention is configured so that the protruding part comes into contact with the guide post or the flange of the slider, preferably with the guide post. Accordingly, by sliding the slider in the closing direction when second separable interfitting part is engaged in the normal position, the slider can be slid smoothly without the protruding part being caught by the slider.

Further, in the slide fastener of the invention, the slider-holding part includes a swelling portion protruding to the opposite side to the side opposite to the second separable interfitting part. Accordingly, when the slider is held on the slider-holding part, the slider can be caused to significantly tilt to the side of the second separable interfitting part with respect to the tape length direction compared with a case when no swelling portion is arranged in the slider-holding part.

Then, if the slider can positively significantly be tilted and maintained as described above, the distance between the contact point of the protruding part and the guide post and the contact point of the protruding part and the flange can be reduced when the protruding part of the second separable interfitting part held in an abnormal position is brought into contact with the guide post and the flange of the slider. As a result, the dimension of the protruding part in the tape length direction can be set smaller.

MODE FOR CARRYING OUT THE INVENTION

Preferred embodiments of the invention will be described in detail below with reference to the drawings by citing embodiments. However, the invention is not limited to each embodiment described below and various modifications can be made insofar as the substantially same configuration as that of the invention is included and a similar operation/effect is achieved.

For example, in the examples described below, a case when a first separable interfitting part is arranged on a back end side of a right fastener stringer and a second separable interfitting part is arranged on a back end side of a left fastener stringer will be described. However, the invention is not limited to such a case and can similarly be applied when the second separable interfitting part is arranged on the right fastener stringer and the first separable interfitting part is arranged on the left fastener stringer or when the first and second separable interfitting parts are arranged on a front end side of the fastener stringer.

Also in the examples described below, an element row in which a plurality of synthetic resin fastener elements is injection-molded is formed at a tape-side edge of the fastener tape. However, according to the invention, an element row may be formed by sewing coil-shaped or zigzag continuous fastener elements to the tape-side edge of the fastener tape or an element row may be formed by swaging and attaching metallic fastener elements.

First Embodiment

Figure 1:
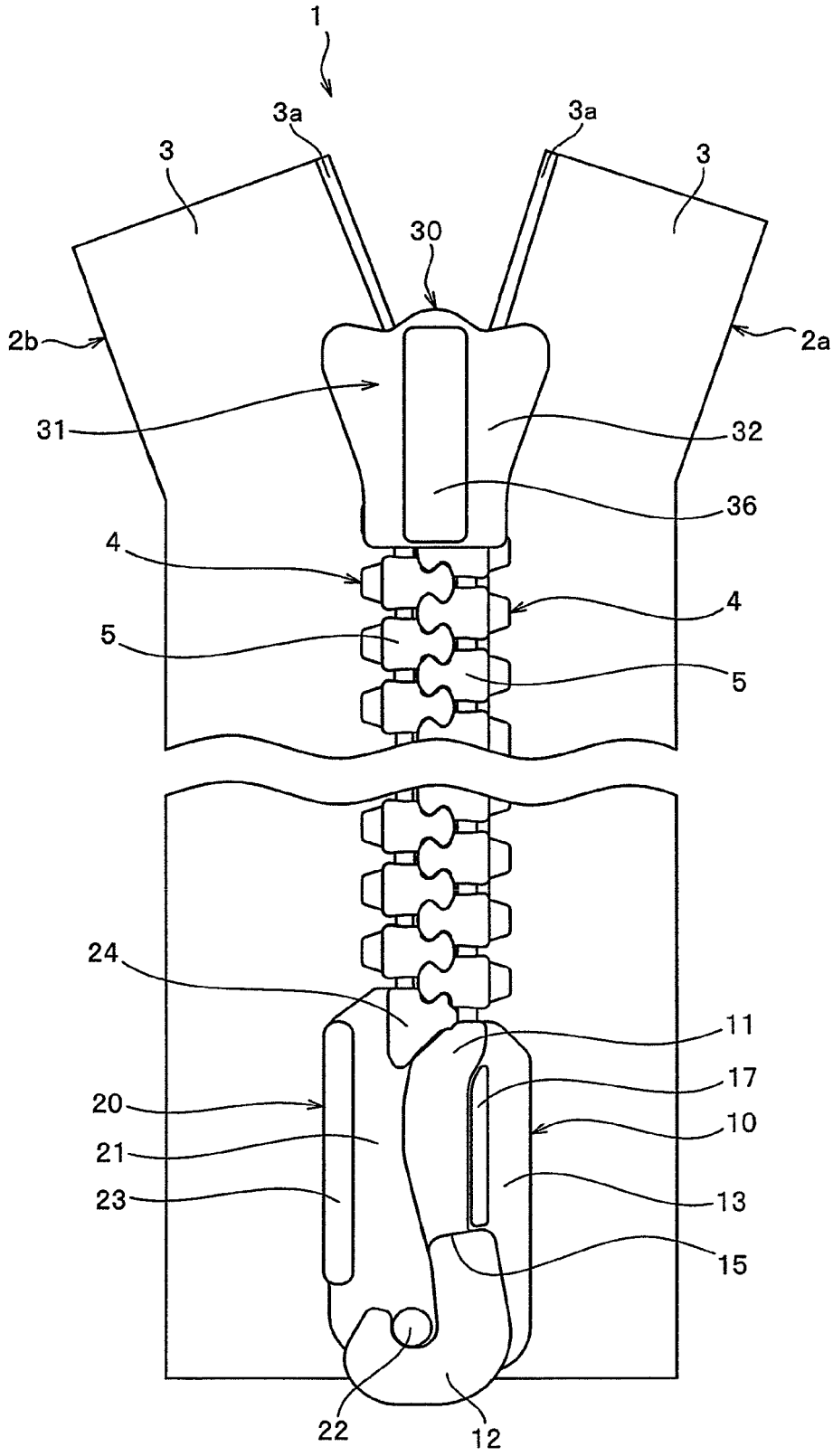
FIG. 1 is a front view showing a slide fastener according to a first embodiment of the invention.
Figure 2:
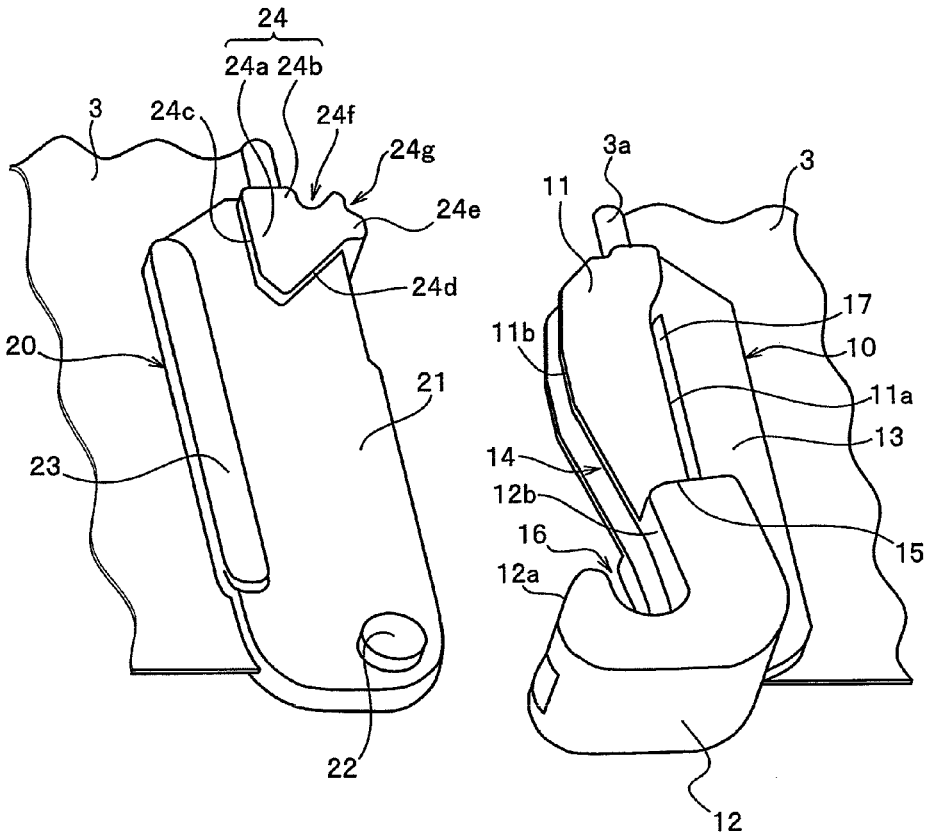
FIG. 2 is a perspective view showing first and second separable interfitting parts in the slide fastener.

FIG. 1 is a front view showing a slide fastener according to the first embodiment of the invention and FIG. 2 is a perspective view showing first and second separable interfitting parts in the slide fastener. In the description that follows, the forward and backward direction refers to a length direction of the fastener tape of a slide fastener and the sliding direction of the slider when the slide fastener is closed is defined as the forward direction and the sliding direction of the slider when the slide fastener is opened is defined as the backward direction.

The right and left direction refers to a tape width direction of a fastener tape and the right side and the left side when the slide fastener is viewed from the front side is defined as the right direction and the left direction respectively. The up and down direction refers to a tape front and back direction perpendicular to the tape surface of a fastener tape and the side on which the tab of the slider is arranged with respect to the fastener tape is defined as the upper side and the opposite side thereof is defined as the lower side.

A slide fastener 1 according to the first embodiment includes a pair of first and second fastener stringers 2*a*, 2*b* in which an element row 4 is formed on right and left fastener tapes 3, a first separable interfitting part 10 (may also be called a box pin) arranged continuously from the back end of the element row 4 in the first fastener stringer 2*a* on the right side, a second separable interfitting part 20 (may also be called an insert pin) arranged continuously from the back end of the element row 4 in the second fastener stringer 2*b* on the left side, and a slider 30 slidably attached along the element row 4 of the first fastener stringer 2*a*.

The first and second fastener stringers 2*a*, 2*b* each include the fastener tape 3, the element row 4 formed at the tape-side edge where the fastener tapes 3 are opposed, and a stop (not shown) that prevents the slider 30 from getting out fixed at the front end of the element row 4. The right and left fastener tapes 3 have a core thread 3*a* at the opposed tape-side edge.

Each of the right and left element rows 4 is formed of a plurality of synthetic resin fastener elements 5 attached to the tape-side edge (element attaching portion) including the core thread 3*a* of the fastener tape 3 at regular intervals. Each of the fastener elements 5 includes a body 5*a* fixed to the fastener tape 3, a neck 5*b* extending from the body 5*a* to the outside of the tape and having a constricted shape in the forward and backward direction, a coupling head 5*c* provided at the tip of the neck 5*b*, a shoulder 5*d* protruding in the forward and backward direction from the neck 5*b*, and a fin portion 5*e* extending from the body 5*a* toward the tape inner side and fixed to the fastener tape 3. The fastener element 5 is formed into a predetermined shape by injection-molding a synthetic resin material such as polyacetal, polyethylene terephthalate, and polyamide. In the invention, the shape and size of the fastener element 5 are not specifically limited.

A slider that has generally been known can be used as the slider 30 in the first embodiment. More specifically, the slider includes a slider body 31 and a tab (not shown). The slider body 31 includes an upper blade 32, a lower blade 33, a guide post 34 connecting the upper and lower blades 32, 33 at the front end, upper and lower flanges 35 arranged in a direction perpendicular to the upper and lower blades 32, 33 from a right and left side edge of the upper and lower blades 32, 33, a tab attaching post 36 installed upright on the upper surface of the upper blade 32, and a locking pawl 37 arranged on the upper blade 32.

A tape insertion gap allowing the fastener tape 3 to be inserted into is formed at a right and left side edge of the slider body 31 between the upper and lower flanges 35. The tab is rotatably attached to the tab attaching post 36.

A posterior orifice is arranged at the back end of the slider 30 and a shoulder is arranged on the front end side of the slider 30 and both right and left sides of the guide post 34. The slider 30 also has an element guide passage 38 enclosed with the upper and lower blades 32, 33 and the upper and lower flanges 35 and the element guide passage 38 is arranged in a substantially Y shape so that the posterior orifice of the slider 30 and right and left shoulders are communicatively connected. The slider used in the invention may be, for example, a slider having a flange arranged at a right and left side edge of one of the upper blade and the lower blade.

The first separable interfitting part 10 arranged in the first fastener stringer 2*a* and the second separable interfitting part 20 arranged in the second fastener stringer 2*b* are each fixed extending over both tape front and back sides of the fastener tape 3 so as to be continuous from the back end of the element row 4. The first and second separable interfitting parts 10, 20 are formed by injection-molding a synthetic resin material such as polyacetal, polyethylene terephthalate, and polyamide in such a way that the shape on the tape front side and the shape on the tape back side become symmetric with respect to the fastener tape 3.

In the first embodiment, the first separable interfitting part 10 includes a slider-holding part 11 formed on both front and back sides of the fastener tape 3, a pivotal stopping part 12 extending backward from the slider-holding part 11 and formed thick via a stepped portion 15, a reinforcing part 13 extending from the slider-holding part 11 and the pivotal stopping part 12 toward the tape inner side, and a concave groove 14 provided in the opposed side opposite to the second separable interfitting part 20 of the slider-holding part 11 and an inner circumferential surface 12*b* of the pivotal stopping part 12.

The slider-holding part 11 is formed in such a way that the thickness (thickness dimension) in the tape front and back direction is smaller than the thickness dimension of the element guide passage 38 of the slider 30 (that is, the interval between the inner wall surface of the upper blade 32 and the inner wall surface of the lower blade 33) and larger than the interval of the tape insertion gap of the slider 30. An inner-side edge 11*a* on the tape inner side of the slider-holding part 11 has an intermediate portion in the length direction curved to be dented toward the second separable interfitting part 20 and an opposite-side edge 11*b* opposite to the second separable interfitting part 20 of the slider-holding part 11 has an intermediate portion in the length direction curved to be swelling toward the second separable interfitting part 20.

When the slider 30 is slid backward (separating direction) to come into contact with the stepped portion 15, the slider-holding part 11 can hold the slider 30 inserted into the element guide passage 38 of the slider 30 in a state of being in contact with the stepped portion 15. This position is the end of sliding of the slider 30 and thus can be said to be a sliding end.

When the slider-holding part 11 holds the slider 30, the slider-holding part 11 can tilt the posture of the slider 30 in a predetermined direction by bringing the guide post 34 of the slider 30 into contact with the opposite-side edge 11*b* opposite to the second separable interfitting part 20 of the slider-holding part 11 and bringing the flange 35 of the slider 30 into contact with the inner-side edge 11*a* on the tape inner side of the slider-holding part 11.

The pivotal stopping part 12 is formed thicker than the slider-holding part 11 in the front and back direction through the stepped portion 15. The pivotal stopping part 12 extends backward from the slider-holding part 11 and is formed by being curved toward the second separable interfitting part 20 in a position further backward from the tape end of the fastener tape 3. Thus, the pivotal stopping part 12 presents a substantially J shape when viewed from the front side. In this case, an outer circumferential surface 12*a* at the curved tip of the pivotal stopping part 12 is formed in a tilted state so as to be tilted toward the fastener tape 3 with respect to the tape length direction.

The pivotal stopping part 12 includes the inner circumferential surface 12*b* that freely rotatingly engages by a pivotal stopped part 22 described later of the second separable interfitting part 20 being brought into contact and is configured in such a way that a pivotal movement space 16 into which the pivotal stopped part 22 described later of the second separable interfitting part 20 can be inserted is formed between the end on the posterior orifice side of the slider 30 and the pivotal stopping part 12 when the slider 30 is held on the slider-holding part 11 of the first separable interfitting part 10.

In this case, the pivotal movement space 16 is formed in such a way that the pivotal stopped part 22 of the second separable interfitting part 20, after being guided to the inner circumferential surface 12*b* of the pivotal stopping part 12 through a gap formed between the end on the posterior orifice side of the slider 30 and the curved tip of the pivotal stopping part 12, can be engaged with the inner circumferential surface 12*b*.

The reinforcing part 13 is arranged to reinforce fixing strength of the first separable interfitting part 10 to the fastener tape 3. The thickness dimension of the reinforcing part 13 in the tape front and back direction is set smaller than the interval of the tape insertion gap of the slider 30. The reinforcing part 13 has a dent 17 provided at an edge on the side of the slider-holding part 11.

The concave groove 14 provided in the slider-holding part 11 and the pivotal stopping part 12 has a groove width dimension in the tape front and back direction of the concave groove 14 set larger than the thickness of a body part 21 described later of the second separable interfitting part 20 so that the body part 21 of the second separable interfitting part 20 can be fitted into. Also, the groove width dimension of the concave groove 14 in the tape front and back direction is set smaller than the thickness dimension of the pivotal stopped part 22 in the tape front and back direction to engage the pivotal stopped part 22 of the second separable interfitting part 20 with the inner circumferential surface 12*b* of the pivotal stopping part 12.

In the first embodiment, the second separable interfitting part 20 includes the body part 21 in a plate shape integrally formed on front and back surfaces of the fastener tape 3, the pivotal stopped part 22 arranged in a corner portion of the first separable interfitting part 10 at the back end of the body part 21, a projected rim 23 arranged along an edge on the tape inner side of the body part 21, and a protruding part 24 arranged at the front end of the body part 21.

The body part 21 of the second separable interfitting part 20 is formed flat on the front side and the back side and the thickness dimension of the body part 21 in the tape front and back direction is set smaller than the interval of the tape insertion gap formed at a right and left side edge of the slider 30. The thickness dimension of the body part 21 is set, as described above, smaller than the groove width dimension in the tape front and back direction of the concave groove 14 provided in the first separable interfitting part 10.

The pivotal stopped part 22 is formed in a cylindrical shape protruding upward and downward from the front surface and back surface of the body part 21. The thickness dimension in the tape front and back direction between the front surface and back surface in the pivotal stopped part 22 is set larger than the interval of the tape insertion gap of the slider 30 and smaller than the thickness dimension of the element guide passage 38 of the slider 30 (that is, the interval between the inner wall surface of the upper blade 32 and the inner wall surface of the lower blade 33).

The projected rim 23 is formed thicker than the body part 21. With the above projected rim 23 formed along a side edge on the tape inner side in the body part 21, the strength of the second separable interfitting part 20 can be improved. Further, with the projected rim 23 arranged, the second separable interfitting part 20 can be made easier for the user of the slide fastener 1 to grip so that operability of the slide fastener 1 can be improved.

The protruding part 24 is integrally formed in the body part 21 of the second separable interfitting part 20 so as to be continuous from the element row 4 of the second fastener stringer 2*b*. The thickness dimension of the protruding part 24 in the tape front and back direction is set, like the pivotal stopped part 22, larger than the interval of the tape insertion gap of the slider 30 and smaller than the thickness dimension of the element guide passage 38 and is set to, for example, the same size as the thickness dimension of the fastener element 5.

The protruding part 24 in the first embodiment includes a protruding body part 24*a* on the back end side formed in a substantially right-angled triangle shape and an interlocking part 24*b* capable of coupling with the fastener element 5 arranged on the farthest back end side of the element row 4 in the first fastener stringer 2*a* (hereinafter, the fastener element 5 will be denoted as the first fastener element 5).

The protruding body part 24*a* in the protruding part 24 includes a side surface 24*c* arranged on the tape inner side (opposite side of the side opposed to the first separable interfitting part 10) along the tape length direction and an inclined surface 24*d* corresponding to an oblique side of a right-angled triangle. An opposed end (corner) 24*e* corresponding to a vertex of a right-angled triangle is arranged at an end of the inclined surface 24*d* on the side opposite to the first separable interfitting part 10 and the opposed end (corner) 24*e* is formed so as to be slightly swelled to the side of the inclined surface 24*d*. Further, a crossing portion of the side surface 24*c* and the inclined surface 24*d* is arranged on the backward side from the opposed end 24*e* and is formed in a curved surface shape like chamfered.

The interlocking part 24*b* in the protruding part 24 is configured in such a way that the first fastener element 5 of the first fastener stringer 2*a* can be interlocked between the fastener element 5 arranged on the farthest back end side of the second fastener stringer 2*b* and the interlocking part 24*b*. A first recess 24*f* into which the coupling head 5*c* of the first fastener element 5 is fitted and a second recess 24*g* into which the shoulder 5*d* of the first fastener element 5 is fitted are provided at a front edge of the interlocking part 24*b*.

Figure 3:
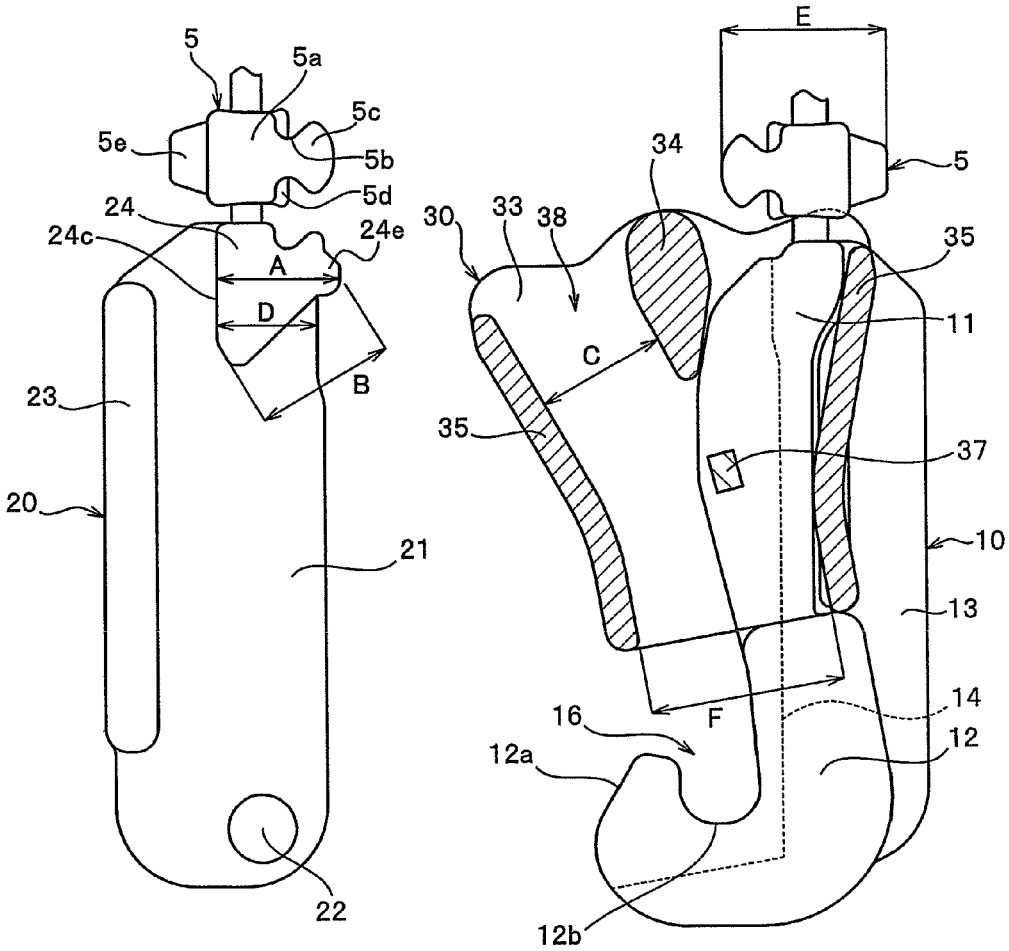
FIG. 3 is a front view showing the first separable interfitting part holding a slider on a slider-holding part and the second separable interfitting part.

In the slide fastener 1 according to the first embodiment, as shown in FIG. 3, the dimension of the protruding part 24 in the tape width direction (dimension of the protruding part 24 in a direction perpendicular to the axis line of the element row 4), in other words, the dimension (minimum dimension) between an edge opposite to the first separable interfitting part 10 at the opposed end 24*e* of the protruding part 24 and the side surface 24*c* of the protruding part 24 is defined as a first dimension A.

The dimension between the back end of the side surface 24*c* in the protruding part 24 and the opposed end 24*e* is defined as a second dimension B. In this case, the orientation of the second dimension B is a direction perpendicular to a straight line tilted toward the left side (direction in which the front end moves away from the first fastener stringer 2*a*) with respect to the axis line of the element row 4. Further, the dimension equal to the minimum interval between the guide post 34 and the flange 35 in the element guide passage 38 on the shoulder side of the slider 30 is defined as a dimension C.

If the first dimension A to the third dimension C are defined as described above, the protruding part 24 in the first embodiment is formed so as to have the relationship of first dimension A<third dimension C<second dimension B. That is, if the second separable interfitting part 20 is held in a normal position with respect to the first separable interfitting part 10 as will be described later, the slider 30 can smoothly be inserted between the guide post 34 and the flange 35 of the slider 30 when the slider 30 held by the slider-holding part 11 is slid in the closing direction without the slider 30 being caught by the protruding part 24 by the relationship of first dimension A<third dimension C being satisfied by the protruding part 24.

On the other hand, if the second separable interfitting part 20 is held in an abnormal position with respect to the first separable interfitting part 10 as will be described later, even if an attempt is made to slide the slider 30 held by the slider-holding part 11 in the closing direction, the protruding part 24 comes into contact with both the guide post 34 and the flange 35 of the slider 30 and are caught by both by the relationship of third dimension C<second dimension B being satisfied by the protruding part 24 so that sliding of the slider 30 can be prevented.

The protruding part 24 in the first embodiment is preferably configured so that the orientation of the second dimension B and that of the third dimension C are parallel (including substantially parallel) when the first and second fastener stringers 2*a*, 2*b* are arranged in parallel and the slider 30 is held in a posture tilted toward a predetermined direction with respect to the slider-holding part 11 of the first separable interfitting part 10. Accordingly, when the second separable interfitting part 20 is held in an abnormal position, the protruding part 24 can prevent sliding of the slider 30 more reliably.

Figure 10:
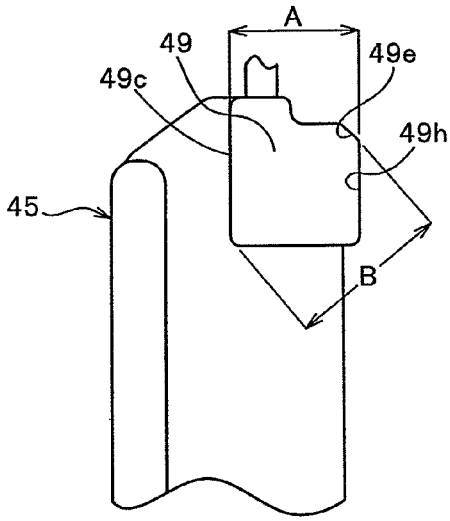
FIG. 10 is a schematic diagram showing another modification of the second separable interfitting part.

In the above description, the second dimension B is defined as the dimension between the back end of the side surface 24*c* and the opposed end 24*e*, but, for example, if the end on both sides opposite to the side surface 24*c* on a virtual line perpendicular to a straight line tilted toward the left side with respect to the axis line of the element row 4 and passing through the back end of the side surface 24*c* is set as an opposed end on the side opposite to the first separable interfitting part 10, the second dimension B can also be represented as the dimension between the opposed end and the back end of the side surface 24*c*. The opposed end is positioned on a side (front side) closer to the element row 4 than the back end of the side surface 24*c*. The opposed end is not limited to a rectangular corner and may also have a fan shape. Alternatively, as shown in FIG. 10, the opposed end may have a chamfered slope shape.

Further, in the slide fastener 1 according to the first embodiment, as shown in FIG. 3, the dimension in the tape width direction between the side surface 24*c* of the protruding part 24 and an opposed-side surface opposed to the first separable interfitting part 10 on the front end side of the body part 21 is defined as a fourth dimension D. Also, the dimension of the fastener element 5 in the tape width direction is defined as a fifth dimension E. In this case, the fifth dimension E is a dimension in the tape width direction of an element portion of the fastener element 5 inserted through the element guide passage 38, that is, an element portion obtained by removing the fin portion 5*e* of the fastener element 5. Further, the width dimension of the end on the posterior orifice side in the element guide passage 38 of the slider 30 (dimension between the flanges 35 arranged at a right and left side edge at the end on the posterior orifice side) is defined as a sixth dimension F.

If the fourth dimension D to the sixth dimension F are defined as described above, the second separable interfitting part 20 in the first embodiment is formed so as to have the relationship of fourth dimension D+fifth dimension E>sixth dimension F. If the slider 30 is not held on the slider-holding part 11 of the first separable interfitting part 10 and is stopped halfway through the element row 4 of the first fastener stringer 2*a* as will be described later, even if an attempt is made to slide the slider 30 in the closing direction after the second separable interfitting part 20 is inserted through the element guide passage 38 of the slider 30, sliding of the slider 30 can be prevented by the relationship of the fourth dimension D to the sixth dimension F being satisfied by the second separable interfitting part 20 (see FIG. 8).

Further in this case, in the slide fastener 1 in the first embodiment, the protruding part 24 of the second separable interfitting part 20 is preferably formed so as to have the relationship of first dimension A+fifth dimension E>sixth dimension F.

Accordingly, if the protruding part 24 of the second separable interfitting part 20 and the first fastener element 5 arranged in the first fastener stringer 2*a* do not interlock properly, the protruding part 24 and the first fastener element 5 interfere inside the element guide passage 38 of the slider 30 and are caught. As a result, sliding of the slider 30 is prevented so that incorrect interlocking of the right and left element rows 4 can be prevented.

Next, an operation to close the slide fastener 1 according to the first embodiment from a state in which the first and second fastener stringers 2*a*, 2*b* are separated from each other will be described with reference to the drawings.

First, as shown in FIG. 3, the slider 30 is slid toward the first separable interfitting part 10 arranged in the first fastener stringer 2*a* on the right side to bring the slider 30 into contact with the stepped portion 15 of the first separable interfitting part 10. Accordingly, the slider 30 is held on the slider-holding part 11 of the first separable interfitting part 10. At this point, the pivotal movement space 16 into which the pivotal stopped part 22 of the second separable interfitting part 20 can be inserted is formed between the end on the posterior orifice side of the slider 30 and the pivotal stopping part 12.

Next, the pivotal stopped part 22 of the second separable interfitting part 20 arranged in the second fastener stringer 2*b* on the left side is guided into the pivotal movement space 16 formed on the pivotal stopping part 12 of the first separable interfitting part 10, and the pivotal stopped part 22 is brought into contact with the inner circumferential surface 12*b* of the pivotal stopping part 12 before being stopped. At this point, in the slide fastener 1 according to the first embodiment, one of two engaging operations can arbitrarily be selected.

Figure 4:
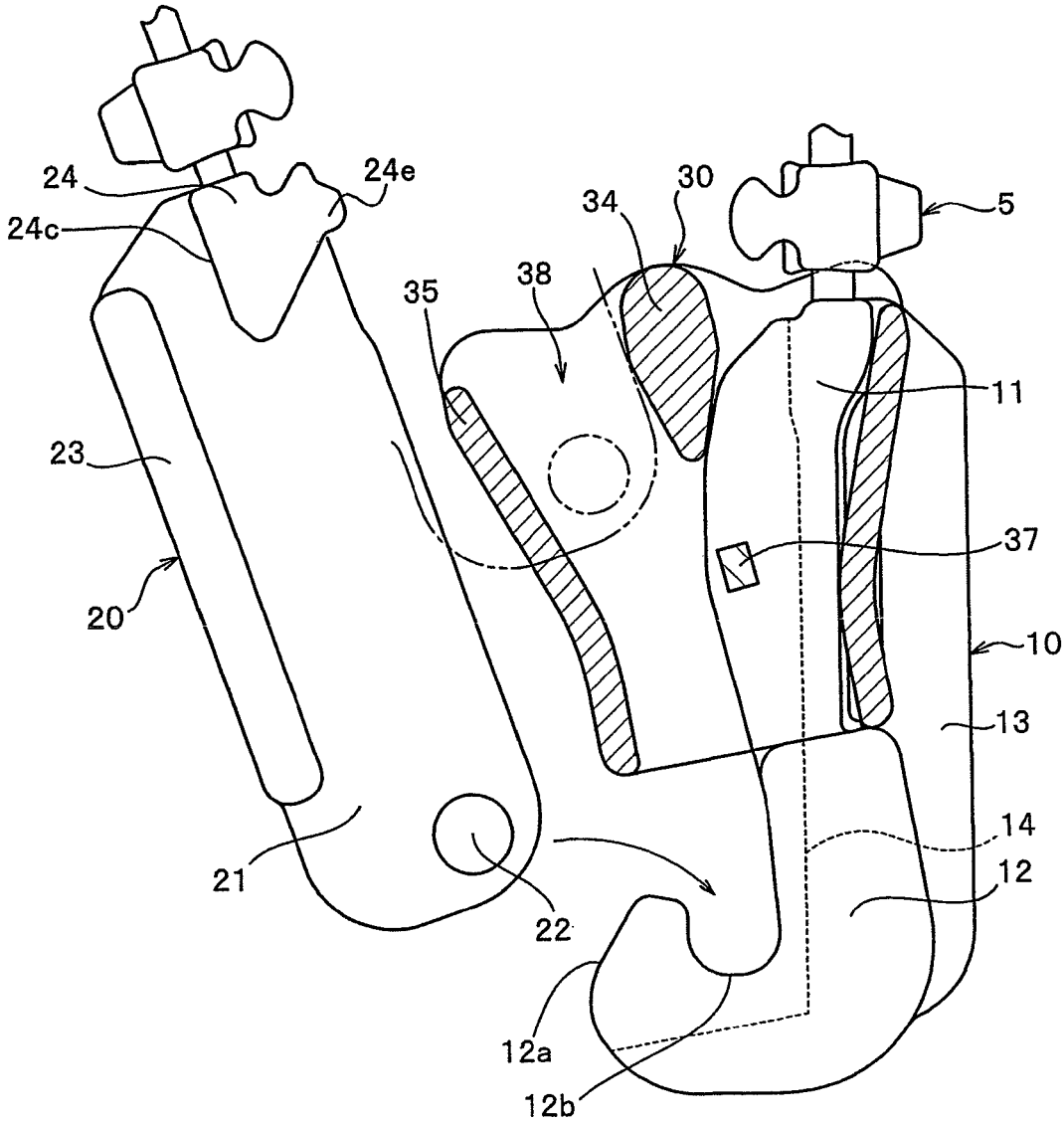
FIG. 4 is an explanatory view schematically illustrating an operation to insert the second separable interfitting part from a shoulder of the slider.

In the first engaging operation, as indicated by an arrow in FIG. 4, the pivotal stopped part 22 of the second separable interfitting part 20 is directly inserted into a gap formed between the pivotal stopping part 12 and the slider 30 from the side (left side) of the first separable interfitting part 10. Accordingly, the pivotal stopped part 22 can be guided into the pivotal movement space 16 of the first separable interfitting part 10 before being engaged with the inner circumferential surface 12*b* of the pivotal stopping part 12. At the same time, the body part 21 of the second separable interfitting part 20 can be fitted into the concave groove 14 of the first separable interfitting part 10 while inserting into the element guide passage 38 through the tape insertion gap of the slider 30.

In this case, in the slide fastener 1 according to the first embodiment, the outer circumferential surface 12*a* on the tip side of the pivotal stopping part 12 is formed, as described above, by being tilted toward the side of the fastener tape 3 with respect to the tape length direction and thus, it can be made easier to insert the pivotal stopped part 22 of the second separable interfitting part 20 into the gap between the pivotal stopping part 12 and the slider 30 from the side of the first separable interfitting part 10.

Figure 5:
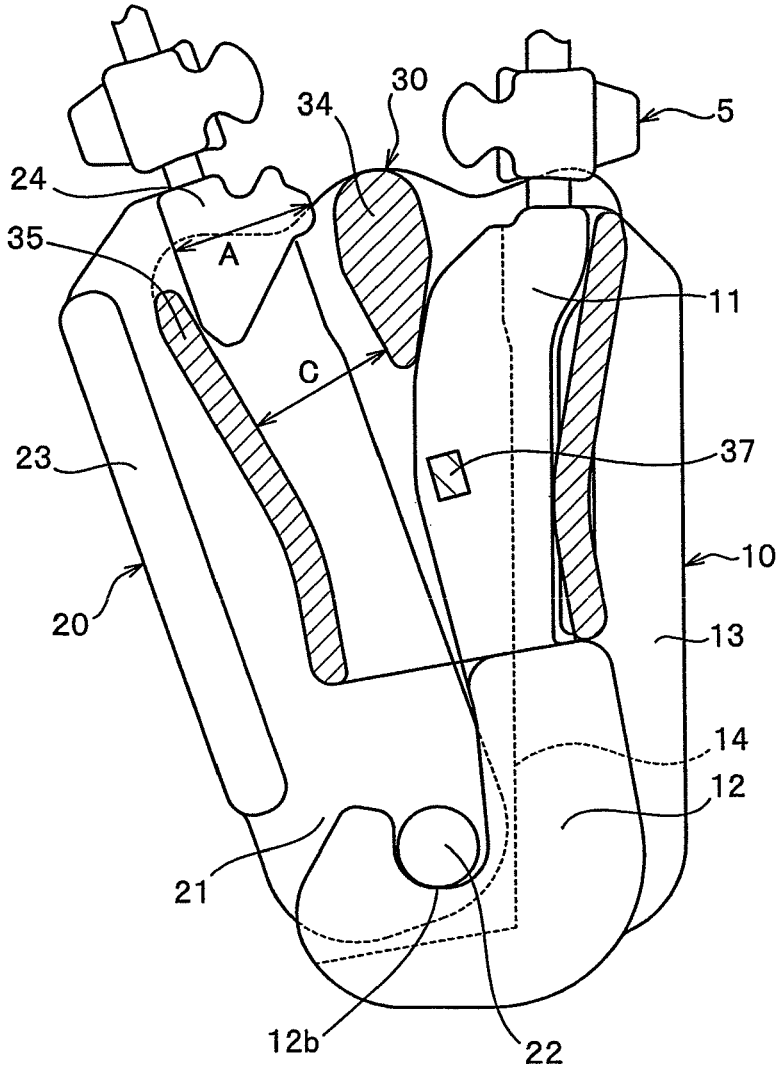
FIG. 5 is a schematic diagram showing a state in which the second separable interfitting part is held in a normal position with respect to the first separable interfitting part.

Next, after the pivotal stopped part 22 being engaged with the pivotal stopping part 12 as described above, the second separable interfitting part 20 is rotated around the pivotal stopped part 22 toward the first separable interfitting part 10 to insert the body part 21 of the second separable interfitting part 20 through the tape insertion gap of the slider 30 in the tape width direction. Accordingly, as shown in FIG. 5, the protruding part 24 of the second separable interfitting part 20 can be inserted into the element guide passage 38 of the slider 30.

When the second separable interfitting part 20 is rotated toward the first separable interfitting part 10, the protruding part 24 of the second separable interfitting part 20 comes into contact with an external surface of the flange 35 of the slider 30 before being inserted into the element guide passage 38 of the slider 30.

In this case, the second separable interfitting part 20 relatively moves forward along the inclined surface 24*d* of the protruding part 24 with the second separable interfitting part 20 rotating while the inclined surface 24*d* of the protruding part 24 comes into contact with the flange 35 of the slider 30 and thus, the protruding part 24 can easily climb over the flange 35 of the slider 30. Further, after the protruding part 24 climbs over the flange 35 of the slider 30, interference between the protruding part 24 and the flange 35 is removed and the second separable interfitting part 20 relatively moves backward to restore a state in which the pivotal stopped part 22 is engaged with the pivotal stopping part 12.

Then, with the protruding part 24 being inserted into the element guide passage 38 of the slider 30 while the pivotal stopped part 22 is engaged with the pivotal stopping part 12 as described above, the second separable interfitting part 20 is positioned with respect to the slider 30 held by the first separable interfitting part 10. Thus, the second separable interfitting part 20 is consequently positioned in a normal position that allows the right and left element rows 4 to interlock properly with respect to the first separable interfitting part 10.

At this point, with the side surface 24*c* of the protruding part 24 coming into contact with the flange 35 of the slider 30, the second separable interfitting part 20 can hold a state in which the second separable interfitting part 20 is positioned in a normal position with stability.

On the other hand, in the second engaging operation, as indicated by a virtual line in FIG. 4, the pivotal stopped part 22 of the second separable interfitting part 20 is inserted from the shoulder of the slider 30. At this point, the thickness dimension of the pivotal stopped part 22 is formed smaller than the interval between the upper blade 32 and the lower blade 33 of the slider 30 and thus, the pivotal stopped part 22 can easily be inserted into the element guide passage 38 of the slider 30.

The pivotal stopped part 22 inserted into the element guide passage 38 passes through the element guide passage 38 before being discharged from the posterior orifice of the slider 30. Further, the pivotal stopped part 22 having passed through the slider 30 is guided to the pivotal stopping part 12 of the first separable interfitting part 10 before being engaged with the inner circumferential surface 12*b* of the pivotal stopping part 12.

At this point, by causing the pivotal stopping part 12 to engage with the pivotal stopped part 22 of the second separable interfitting part 20 via the element guide passage 38 of the slider 30, the body part 21 of the second separable interfitting part 20 can be fitted into the concave groove 14 of the first separable interfitting part 10 and also the protruding part 24 of the second separable interfitting part 20 can be inserted into the element guide passage 38 of the slider 30.

Accordingly, as shown in FIG. 5, the second separable interfitting part 20 is positioned in a normal position allowing the right and left element rows 4 to interlock properly with respect to the first separable interfitting part 10 and also the positioned state can be held with stability.

After the second separable interfitting part 20 is positioned and held in a normal position by performing the first engaging operation or second engaging operation as described above, the slider 30 is slid upward in the closing direction. At this point, in the slide fastener 1 according to the first embodiment, the protruding part 24 satisfies, as described above, the relationship of first dimension A<third dimension C and the orientation of the first dimension A and that of the third dimension C can be made substantially parallel when the protruding part 24 passes between the guide post 34 and the flange 35 of the slider 30.

Thus, the protruding part 24 can be caused to be smoothly inserted between the guide post 34 and the flange 35 of the slider 30 without being caught by the slider 30. Thus, the left element row 4 is introduced into the element guide passage 38 from the shoulder of the slider 30 like being guided to the protruding part 24 and also the right element row 4 is introduced into the element guide passage 38 from the shoulder of the slider 30 and therefore, the right and left element rows 4 can smoothly be interlocked inside the element guide passage 38 and the slide fastener 1 can thereby be closed with stability.

On the other hand, in the slide fastener 1 according to the first embodiment, when, for example, the above first engaging operation is performed, a case when the pivotal stopped part 22 accidentally bursts out of the pivotal stopping part 12 so that the engaged state of the pivotal stopped part 22 is removed may be considered when the protruding part 24 is inserted into the element guide passage 38 of the slider 30 by rotation of the second separable interfitting part 20 after the pivotal stopped part 22 being engaged with the pivotal stopping part 12. In such a case, even if the protruding part 24 is inserted into the element guide passage 38 of the slider 30, as shown in FIG. 6, the second separable interfitting part 20 may be held in an abnormal position deviating from the normal position with respect to the first separable interfitting part 10.

When the above second engaging operation is performed, the user may make an erroneous operation of the second separable interfitting part 20 and insert only the protruding part 24 of the second separable interfitting part 20 into the element guide passage 38 of the slider 30 without inserting the pivotal stopped part 22 of the second separable interfitting part 20 into the element guide passage 38 of the slider 30. Also in this case, as shown in FIG. 6, the second separable interfitting part 20 may be held in an abnormal position with respect to the first separable interfitting part 10.

Figure 6:
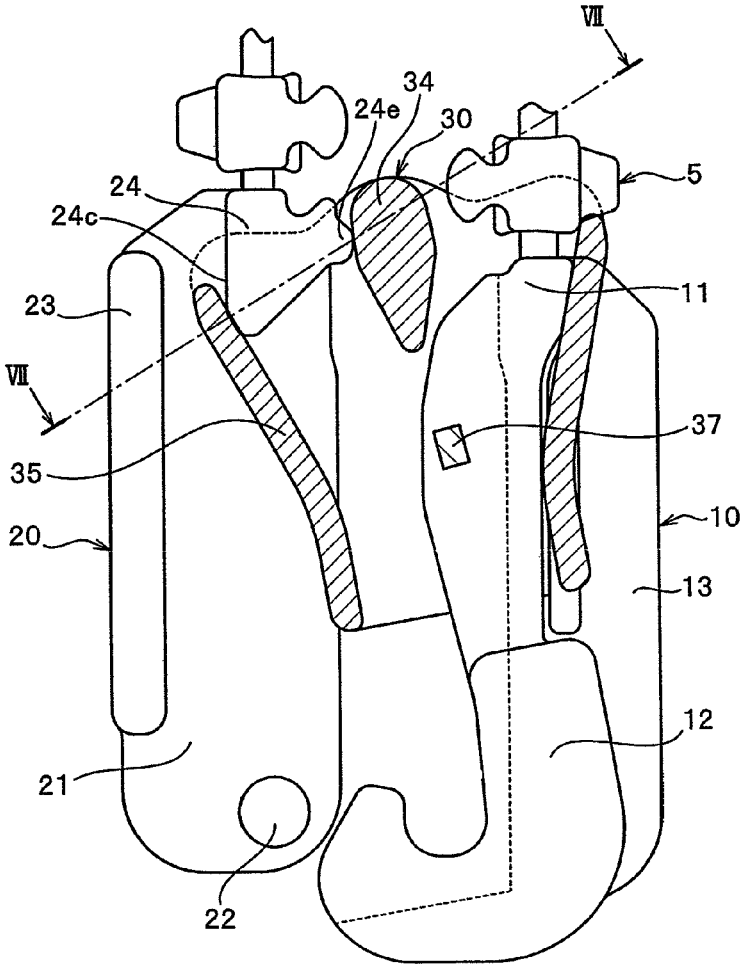
FIG. 6 is a schematic diagram showing a state in which the second separable interfitting part is held in an abnormal position with respect to the first separable interfitting part.
Figure 7:
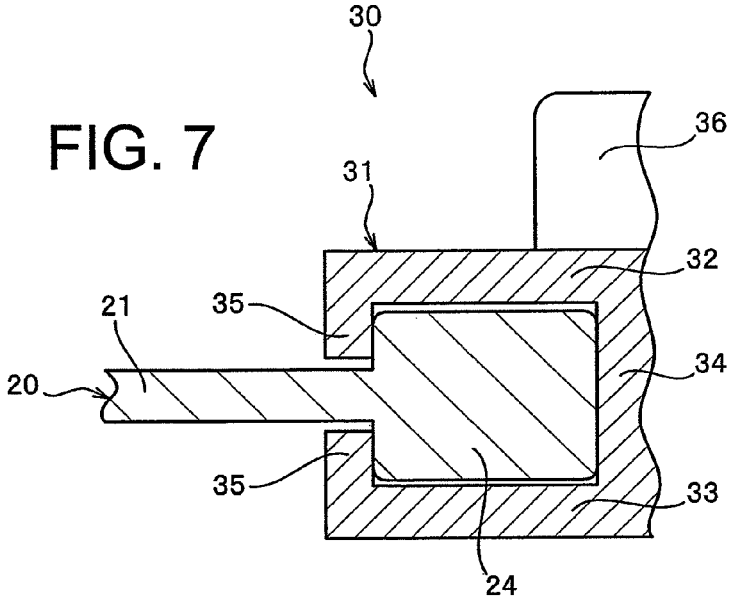
FIG. 7 is an arrowed sectional view along a VII-VII line shown in FIG. 6.

If the second separable interfitting part 20 is held in an abnormal position as described above, the protruding part 24 satisfies, as described above, the relationship of third dimension C<second dimension B in the slide fastener 1 according to the first embodiment and thus, even if an attempt is made to slide the slider 30 held on the slider-holding part 11 in the closing direction, as shown in FIGS. 6 and 7, the protruding part 24 comes into contact with both the guide post 34 and the flange 35 of the slider 30 and is caught so that sliding of the slider 30 can be prevented.

Particularly in this case, with the protruding part 24 being inserted into the element guide passage 38 of the slider 30 in a posture that makes the orientation of the second dimension B and that of the third dimension C substantially parallel, the protruding part 24 reliably comes into contact with both the guide post 34 and the flange 35 of the slider 30. That is, the opposed end 24*e* of the protruding part 24 comes into contact with the guide post 34 of the slider 30 and the side surface 24*c* comes into contact with the flange 35 of the slider 30. Thus, the slider 30 is prevented from sliding in the closing direction.

Accordingly, when the second separable interfitting part 20 is held in an abnormal position, even if the user of the slide fastener 1 attempts to erroneously operate the slider 30, the slider 30 cannot be slid in the fastener closing direction and therefore, incorrect interlocking of the right and left element rows 4 as in the past can reliably be prevented.

As a result, conventional problems, for example, incorrectly interlocked right and left element rows 4 are easily separated after being subjected to a horizontal pulling force or the first and second separable interfitting parts 10, 20 and the fastener elements 5 are damaged after the slider 30 being pulled by force can be resolved. The above abnormal position is a state not being in the above normal position (state deviating from the normal position) in which the pivotal stopped part 22 is engaged with the outer circumferential surface 12*a* of the pivotal stopping part 12.

In the slide fastener 1 according to the first embodiment, when, for example, the slide fastener 1 is closed, a case when the user performs a sliding operation of the slider 30 after erroneously inserting the second separable interfitting part 20 into the slider 30 in a state in which the slider 30 is not held on the slider-holding part 11 and is stopped halfway through the element row 4 of the first fastener stringer 2*a* can be considered.

Figure 8:
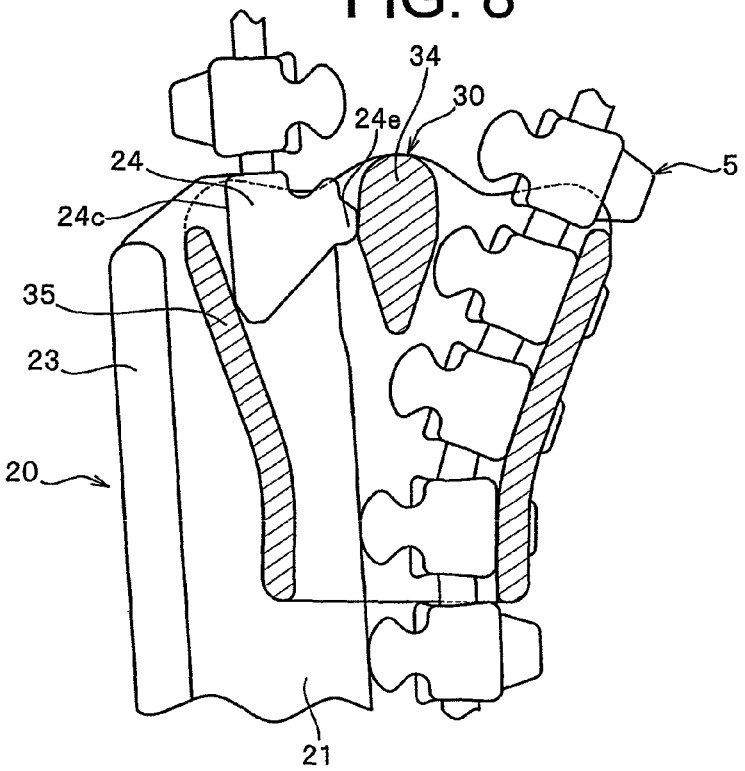
FIG. 8 is a schematic diagram showing a state when the slider is slid in a state in which the slider is not held on a slider-holding part.

In this case, however, the protruding part 24 satisfies, as described above, the relationship of fourth dimension D+fifth dimension E>sixth dimension F in the slide fastener 1 according to the first embodiment and thus, even if an attempt is made to slide the slider 30 in the closing direction, as shown in FIG. 8, sliding of the slider 30 can be prevented.

More specifically, the body part 21 of the second separable interfitting part 20 and the fastener elements 5 arranged in the first fastener stringer 2*a* come into contact inside the element guide passage 38 of the slider 30 in the state of FIG. 8 and the orientation of the second separable interfitting part 20 is forcibly tilted. At this point, the posture of the protruding part 24 of the second separable interfitting part 20 is also tilted inside the element guide passage 38 of the slider 30 and the protruding part 24 comes into contact with both the guide post 34 and the flange 35 of the slider 30 and is caught so that sliding of the slider 30 can be prevented.

Accordingly, even if the user of the slide fastener 1 inserts the second separable interfitting part 20 into the slider 30 in a state halfway through the element row 4 of the first fastener stringer 2*a*, the user cannot erroneously move the slider 30 in the fastener closing direction so that incorrect interlocking of the right and left element rows 4 can be prevented.

In the invention, the form of the protruding part 24 arranged in the second separable interfitting part 20 is not limited to the form described in the first embodiment insofar as the relationship of first dimension A<third dimension C<second dimension B is satisfied by the protruding part 24 and may arbitrarily be changed. For example, as shown in FIG. 9 as a modification, a protruding part 44 of a second separable interfitting part 40 may be formed by dividing into two parts in the forward and backward direction.

Also, for example, as shown in FIG. 10 as another modification, a protruding part 49 of a second separable interfitting part 45 may be formed so that a substantially rectangular shape is presented when viewed from the front side.

The protruding part 49 according to the other modification includes a side surface 49*c* arranged on the tape inner side along the tape length direction and an opposed-side surface 49*h* arranged on the side opposite to the first separable interfitting part 10 along the tape length direction. In this case, the second dimension B of the protruding part 49 is defined as the dimension between the back end on the side surface 49*c* on the tape inner side of the protruding part 49 and an opposed end (corner) 49*e* arranged on the side of the element row 4 on the opposed-side surface 49*h* of the protruding part 49 (that is, the dimension between ends on a substantially diagonal line). The opposed end 49*e* is positioned on a side (front side) closer to the element row 4 than the back end of the opposed-side surface 49*c*.

Figure 9:
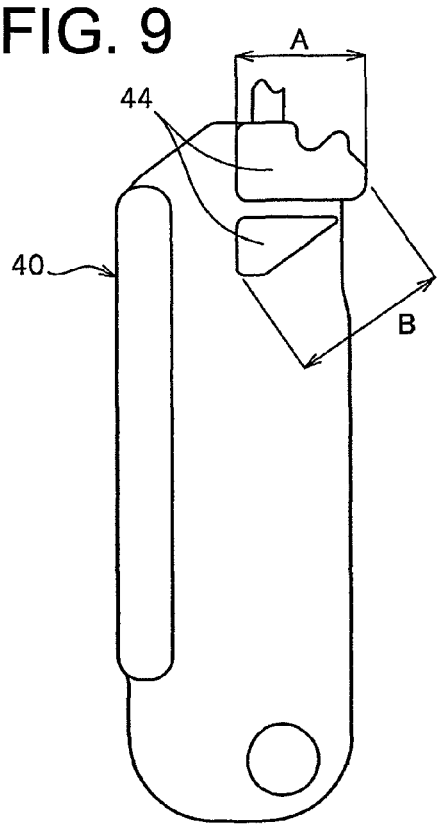
FIG. 9 is a schematic diagram showing a modification of the second separable interfitting part.

Even a slide fastener having the protruding parts 44, 49 as shown in FIGS. 9 and 10 respectively can obtain an effect similar to the effect of the slide fastener 1 according to the first embodiment.

Further, in the first embodiment, the protruding part 24 of the second separable interfitting part 20 is formed symmetrically on the front side and the back side of the fastener tape 3, but the protruding part in the invention may be formed only on the front side or the back side of the fastener tape of a second separable interfitting part.

The slide fastener 1 according to the first embodiment is configured to be able to close the slide fastener 1 by optionally selecting the first engaging operation that causes the pivotal stopping part 12 to engage with the pivotal stopped part 22 of the second separable interfitting part 20 after insertion from the side of the first separable interfitting part 10 or the second engaging operation that causes the pivotal stopping part 12 of the first separable interfitting part 10 to engage with the pivotal stopped part 22 of the second separable interfitting part 20 after causing the pivotal stopped part 22 to pass through the element guide passage 38 of the slider 30. However the invention can also be applied to a slide fastener configured to be able to perform only any one of the first engaging operation and the second engaging operation and an effect similar to that of the first embodiment described above can be obtained.

Second Embodiment

Figure 11:
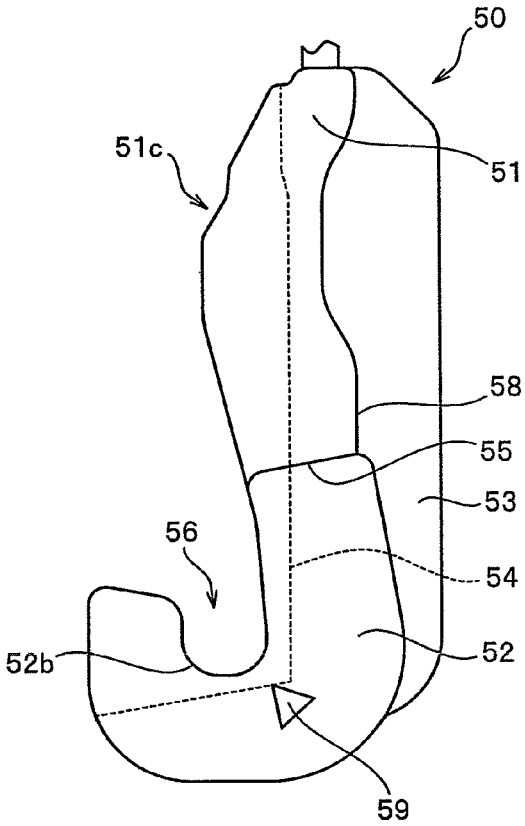
FIG. 11 is a front view showing the first separable interfitting part of the slider fastener according to a second embodiment of the invention.

FIG. 11 is a front view showing the first separable interfitting part of the slider fastener according to the second embodiment of the invention.

A slide fastener 6 according to the second embodiment has basically the same configuration as the slide fastener 1 according to the first embodiment except that a swelling portion 58 is arranged in a first separable interfitting part 50. Therefore, in the slide fastener 6 according to the second embodiment, the same reference numerals are attached to parts and regions with the same configuration as those described in the first embodiment and the description of such parts and regions is omitted.

The first separable interfitting part 50 arranged in the first fastener stringer 2*a* according to the second embodiment on the right side includes, as shown in FIG. 11, a slider-holding part 51 formed on both front and back sides of the fastener tape 3, a pivotal stopping part 52 extending backward from the slider-holding part 51 and formed thick via a stepped portion 55, a reinforcing part 53 extending from the slider-holding part 51 and the pivotal stopping part 52 toward the tape inner side, a concave groove 54 provided in the opposed side opposite to the second separable interfitting part 20 of the slider-holding part 51 and an inner circumferential surface 52*b* of the pivotal stopping part 52, and the swelling portion 58 arranged at the back end of the slider-holding part 51 (end on the side of the pivotal stopping part 52).

The slider-holding part 51 according to the second embodiment is formed in such a way that, like the first embodiment described above, the thickness dimension in the tape front and back direction is smaller than the thickness dimension of the element guide passage 38 of the slider 30 and larger than the interval of the tape insertion gap of the slider 30 and is configured to be able to hold the slider 30 when the slider 30 is brought into contact with the stepped portion 55.

Figure 12:
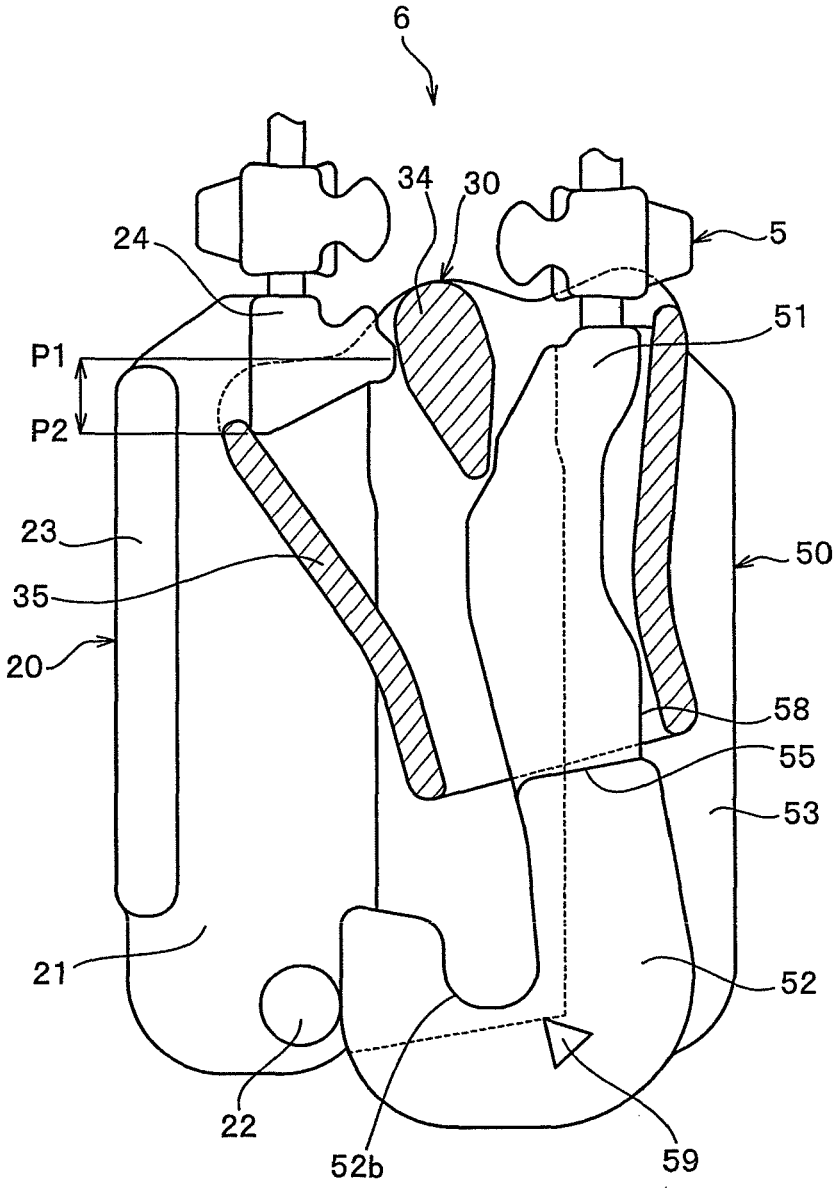
FIG. 12 is a schematic diagram showing a state in which the second separable interfitting part is held in the abnormal position with respect to the first separable interfitting part in the slider fastener.

An opposed side edge opposite to the second separable interfitting part 20 of the slider-holding part 51 is curved so that an intermediate portion of the opposed side edge in the length direction swells out to the side of the second separable interfitting part 20 and a notch portion 51*c* is provided in part of the opposed side edge of the slider-holding part 51 to prevent the guide post 34 of the slider 30 and the slider-holding part 51 from interfering with each other when, as will be described later, the slider 30 is held by being tilted with respect to the slider-holding part 51 (see FIG. 12).

The pivotal stopping part 52 in the second embodiment is formed thicker in the tape front and back direction (up and down direction) than the slider-holding part 51 via the stepped portion 55 and presents a substantially J shape when viewed from the front side. The pivotal stopping part 52 includes the inner circumferential surface 52*b* that allows the pivotal stopped part 22 of the second separable interfitting part 20 to come into contact to freely rotatingly engage with the pivotal stopped part 22.

A triangular mark 59 as a mark to indicate the position where the pivotal stopped part 22 is engaged with understandability is attached to the surface (upper surface) of the pivotal stopping part 52. Further, the pivotal stopping part 52 is configured in such a way that a pivotal movement space 56 into which the pivotal stopped part 22 of the second separable interfitting part 20 can be inserted is formed when the slider 30 is held on the slider-holding part 51.

The swelling portion 58 in the second embodiment is formed by protruding toward the tape inner side from the slider-holding part 51 and the thickness dimension of the swelling portion 58 is set to the same dimension as the thickness dimension of the slider-holding part 51.

With the swelling portion 58 arranged at the back end of the slider-holding part 51, when the slider 30 is held on the slider-holding part 51, as shown in FIG. 12, the swelling portion 58 comes into contact with the flange 35 on the posterior orifice side of the slider 30 so that the posture of the slider 30 can be tilted to the side of the second separable interfitting part 20 by a predetermined angle. Particularly in the second embodiment, the slider 30 held on the slider-holding part 51 is tilted to the side of the second separable interfitting part 20 by the swelling portion 58 in the tape length direction by a larger angle than in the first embodiment described above.

When, as shown in FIG. 12, the second separable interfitting part 20 is held in an abnormal position with respect to the first separable interfitting part 50, a portion where the opposed end 24*e* of the protruding part 24 and the guide post 34 of the slider 30 come into contact is defined as a contact point P1 and a portion where the back end on the side surface 24*c* of the protruding part 24 and the flange 35 of the slider 30 come into contact is defined as a contact point P2.

In this case, when the slider 30 is held on the slider-holding part 51, the interval between the contact point P1 and the contact point P2 in the tape length direction can be made shorter than, for example, the slide fastener 1 according to the first embodiment by, as described above, the slider 30 being significantly tilted to the side of the second separable interfitting part 20.

Accordingly, the tape length of the protruding part 24 arranged in the second separable interfitting part 20 can be set shorter than the slide fastener 1 according to the first embodiment and thus, for example, the outward appearance of the slide fastener 6 can be improved or the manufacturing cost of the slide fastener 6 can be reduced.

In the slide fastener 6 according to the second embodiment, when the second separable interfitting part 20 is held in a normal position with respect to the first separable interfitting part 50, like in the first embodiment, the slide fastener 6 can smoothly be closed by interlocking the right and left element rows 4 by sliding the slider 30 held on the slider-holding part 51 in the closing direction.

Figure 13:
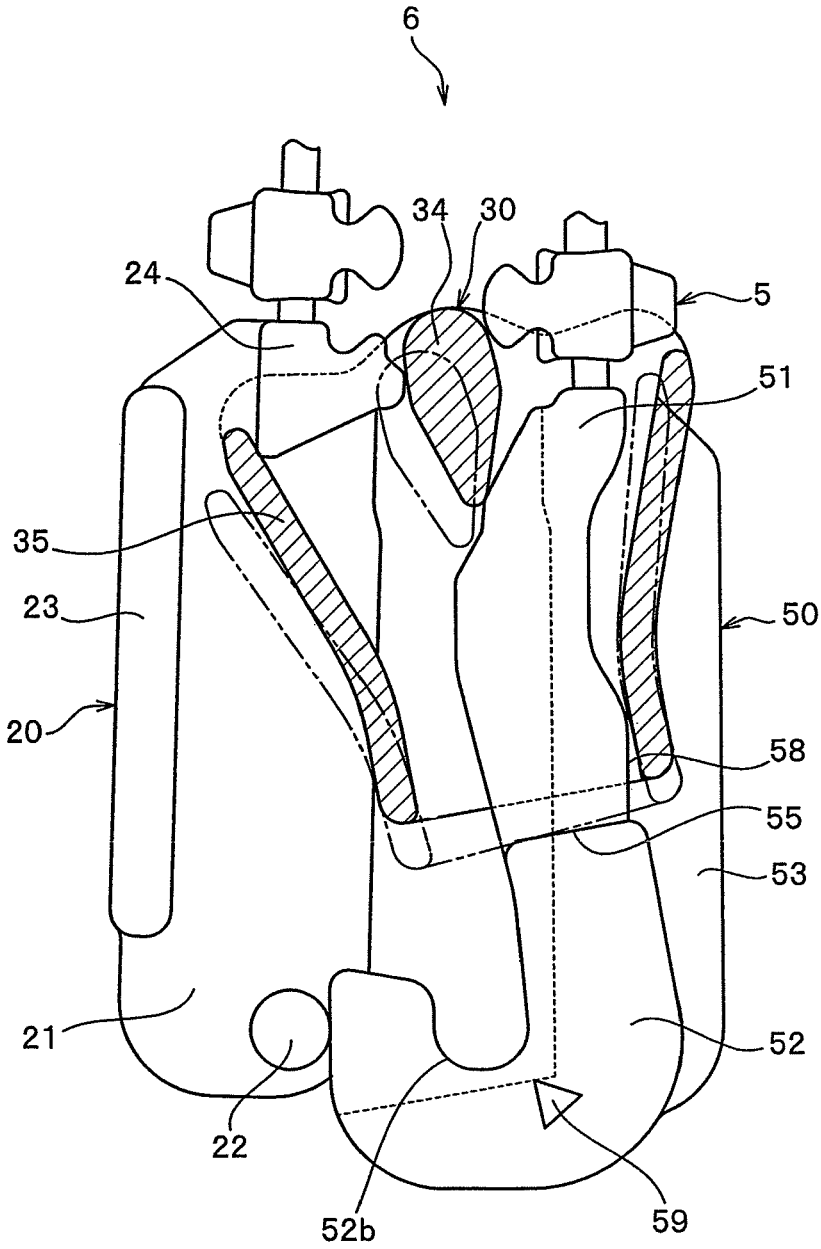
FIG. 13 is an explanatory view schematically illustrating an operation of the slider when the slider is slid in a closing direction from the state shown in FIG. 12.

On the other hand, when the second separable interfitting part 20 is held in an abnormal position with respect to the first separable interfitting part 50, if an attempt is made to slide the slider 30 held on the slider-holding part 51 in the closing direction, as shown in FIG. 13, the protruding part 24 comes into contact with both the guide post 34 and the flange 35 of the slider 30 and is caught so that sliding of the slider 30 can be prevented. Therefore, incorrect interlocking of the right and left element rows 4 can be prevented.

Third Embodiment

Figure 14:
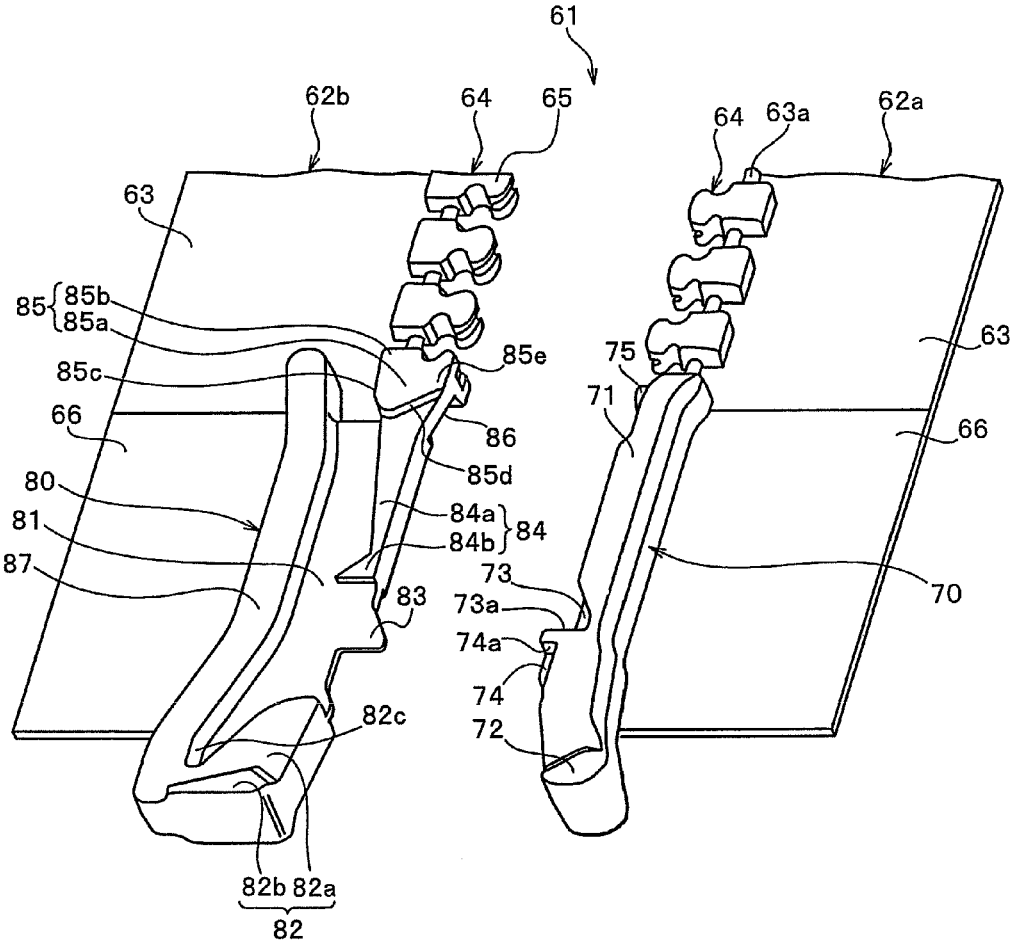
FIG. 14 is a perspective view showing the first and second separable interfitting parts of the slide fastener according to a third embodiment of the invention.

FIG. 14 is a perspective view showing the first and second separable interfitting parts of the slide fastener according to the third embodiment of the invention.

A slide fastener 61 according to the third embodiment includes a pair of first and second fastener stringers 62*a*, 62*b* in which an element row is formed, a first separable interfitting part 70 arranged continuously from the back end of the element row 64 in the first fastener stringer 62*a* on the right side, a second separable interfitting part 80 arranged continuously from the back end of the element row 64 in the second fastener stringer 62*b* on the left side, and a pair of first and second sliders 90*a*, 90*b* slidably attached along the element row 64 of the first fastener stringer 62*a*.

The first slider 90*a* is used as an upward opening slider (so-called up slider) arranged on the side of a stop described later and the second slider 90*b* is used as a downward opening slider (so-called down slider) arranged on the side of the first separable interfitting part 70. Thus, the slide fastener 61 according to the third embodiment is configured as a so-called reverse opening slide fastener.

The first and second fastener stringers 62*a*, 62*b* each have a fastener tape 63 and the element row 64 formed at a tape side edge of the fastener tape 63. In this case, each of the right and left fastener tapes 63 has a core thread 63*a* at the opposed tape edge.

In the first and second fastener stringers 62*a*, 62*b*, the element row 64 in which a plurality of synthetic resin fastener elements 65 is injection-molded and attached is formed along a tape-side edge including the core thread 63*a* of the fastener tape 63. The fastener element 65 in the third embodiment is configured in a form in which the fin portion 5*e* is removed from the fastener element 5 in the first embodiment. Also, a reinforcing part 66 is formed by pasting a resin film to the front and back surfaces of tape at the back end of the fastener tape 63.

The first separable interfitting part 70 arranged in the first fastener stringer 62*a* on the right side is fixed extending over both the front and back surfaces of the fastener tape 63 continuously from the back end of the element row 64.

The first separable interfitting part 70 includes a first body part 71 fixed to the fastener tape 63, a slider-holding part 72 arranged at the back end of the first body part 71, a engaging recess 73 formed on the upper surface side of the first body part 71 and into which a engaging height 83 described later of the second separable interfitting part 80 can be fitted, an accommodating recess 74 formed on the upper surface side of the first body part 71 and capable of accommodating a locking pawl 97 of the second slider 90*b*, and an auxiliary engaging part 75 protruding from the opposed side opposite to the second separable interfitting part 80 of the first body part 71.

The slider-holding part 72 in the first separable interfitting part 70 is formed to have a dimension (thickness dimension) in the up and down direction larger than the dimension of the first body part 71 so as to be able to come into contact with the upper and lower blades of the second slider 90*b*. The slider-holding part 72 configures a sliding end that stops sliding of the second slider 90*b* by bringing the second slider 90*b* into contact.

In this case, the slider-holding part 72 can hold the second slider 90*b* on the first fastener stringer 62*a* by bringing the second slider 90*b* into contact to stop the second slider 90*b* and can hold the first slider 90*a* on the first fastener stringer 62*a* by bringing the first slider 90*a* into contact with the second slider 90*b* held on the slider-holding part 72 to stop the first slider 90*a*. These positions are ends of sliding of the first and second slider 90*a*, 90*b* and thus can be called sliding ends.

The engaging recess 73 is depressed from an opposed side opposite to the second separable interfitting part 80 toward the inner side of tape. In this case, a wall surface 73*a* on the back side formed in the engaging recess 73 is arranged perpendicularly to the tape length direction and further, protrudes to the side of the second separable interfitting part 80 more than the opposed side on the front side of the first body part 71 so that the engaging height 83 described later of the second separable interfitting part 80 can be supported with stability.

The accommodating recess 74 in the first separable interfitting part 70 is arranged in a position on the backside from the engaging recess 73. The accommodating recess 74 can accommodate the locking pawl 97 of the second slider 90*b* and also can hold a stopped state of the second slider 90*b* by bringing the accommodated locking pawl 97 into contact with a wall surface 74*a* on the front side formed in the accommodating recess 74.

The auxiliary engaging part 75 in the first separable interfitting part 70 is arranged at the front end of the first body part 71 and projected from the opposed side of the first body part 71 toward the outside of tape (left side). The auxiliary engaging part 75 is formed so as to present a substantially triangular shape when viewed from the front side and the thickness dimension of the auxiliary engaging part 75 in the up and down direction is set to substantially half the thickness dimension of the first body part 71.

The second separable interfitting part 80 arranged in the second fastener stringer 62*b* on the left side is fixed extending over both the tape front and back surfaces of the fastener tape 63 continuously from the back end of the element row 64.

The second separable interfitting part 80 includes a second body part 81 fixed to the fastener tape 63, a slider-engaging/releasing part 82 arranged at the back end of the second body part 81, the engaging height 83 protruding from the opposed side opposite to the first separable interfitting part 70 of the second body part 81, a protuberance 84 arranged on the upper surface and lower surface of the second body part 81, a protruding part 85 arranged at the front end of the second body part 81, an insertion recess 86 formed on the lower surface side of the second body part 81 and into which the auxiliary engaging part 75 of the first separable interfitting part 70 can be inserted, and a rib portion 87 arranged along the edge of the second body part 81 on the tape inner side.

The slider-engaging/releasing part 82 in the second separable interfitting part 80 includes a first engaging/releasing part 82*a* formed thicker than the second body part 81 and capable of engaging with a shoulder-side end of the upper and lower flanges 95 of the second slider 90*b* and a second engaging/releasing part 82*b* formed thicker than the first engaging/releasing part 82*a* and capable of engaging with a shoulder-side edge of the upper and lower blades of the second slider 90*b*.

The first engaging/releasing part 82*a* is formed thicker than tape insertion gap formed between upper and lower flanges 95 and thinner than the interval between the upper blade and the lower blade on the shoulder side of the second slider 90*b*. The thickness dimension of the second engaging/releasing part 82*b* is set larger than the interval between the upper and lower blades of the second slider 90*b*.

Further in this case, an insertion groove 82*c* into which the upper and lower flanges 95 of the second slider 90*b* can be inserted is formed in the first engaging/releasing part 82*a*. Thus, the second separable interfitting part 80 can solidly be supported by the slider-engaging/releasing part 82 with respect to the second slider 90*b*.

The slider-engaging/releasing part 82 is formed in such a way that the groove width of the insertion groove 82*c* of the slider-engaging/releasing part 82 becomes gradually wider in the forward direction and the width dimension of the second engaging/releasing part 82*b* gradually decreases in the forward direction so as to be rotatable while the second separable interfitting part 80 is engaged with the second slider 90*b*.

The engaging height 83 in the second separable interfitting part 80 is projected from an upper surface side region on the opposed side of the second body part 81 toward the outside of tape (right side) so as to be engagable by being inserted into the engaging recess 73 formed in the first separable interfitting part 70. The engaging height 83 is formed so as to present a substantially triangular shape when viewed from the front side and the lower end edge of the engaging height 83 is perpendicular to the tape length direction.

The protuberance 84 in the second separable interfitting part 80 is formed by rising from the upper surface and lower surface of the second body part 81. In this case, the thickness dimension of the protuberance 84 from the second body part 81 is set smaller than the thickness dimension of the protruding part 85 from the second body part 81. The protuberance 84 includes a removal stop protuberance 84*a* arranged to extend backward from the protruding part 85 and a position-holding protuberance 84*b* arranged continuously from the back end of the removal stop protuberance 84*a*.

An opposed side (right-side side) opposite to the first separable interfitting part 70 in the removal stop protuberance 84*a* is arranged on the same surface as an opposed side of the second body part 81. The width dimension in the right and left direction of the removal stop protuberance 84*a* gradually decreases in the backward direction. As will be described later, the removal stop protuberance 84*a* is formed so as to interfere with the upper and lower flanges 95 of the second slider 90*b* when the second slider 90*b* is slid forward after the second separable interfitting part 80 being inserted into the first and second sliders 90*a*, 90*b*. Accordingly, when the second slider 90*b* slides forward from the state in which the second slider 90*b* is held by the slider-engaging/releasing part 82 (particularly, the first engaging/releasing part 82*a*) of the second separable interfitting part 80, the second separable interfitting part 80 can be prevented from being pulled out of the second slider 90*b*.

An opposed side (right-side side) in the position-holding protuberance 84*b* is arranged on the same surface as an opposed side of the second body part 81. The width dimension in the right and left direction of the position-holding protuberance 84*b* gradually decreases in the backward direction. Thus, the edge on the tape inner side of the whole protuberance 84 is curved like being recessed to the side of the opposed side when viewed from the front side.

As will be described later, the position-holding protuberance 84*b* is formed so as to come into contact with the end on the posterior orifice side of the upper and lower flanges 95 of the second slider 90*b* when the second separable interfitting part 80 is inserted into the first and second sliders 90*a*, 90*b*. Accordingly, the second separable interfitting part 80 can be positioned to a predetermined position so that the position of the second separable interfitting part 80 inserted into the first and second sliders 90*a*, 90*b* is not shifted to the backward side.

The protruding part 85 in the third embodiment arranged in the second separable interfitting part 80 has substantially the same configuration as the protruding part 24 in the first embodiment. That is, the protruding part 85 in the third embodiment is integrally formed in the second body part 81 of the second separable interfitting part 80 so as to be continuous from the element row 64 of the second fastener stringer 62*b*. The thickness dimension of the protruding part 85 in the tape front and back direction is set larger than the interval of the tape insertion gap of the first and second sliders 90*a*, 90*b* and smaller than the thickness dimension of the element guide passage of the first and second sliders 90*a*, 90*b*.

The protruding part 85 in the third embodiment includes a protruding body part 85*a* on the back end side formed in a substantially right-angled triangle shape and an interlocking part 85*b* arranged in front of the protruding body part 85*a* and the protruding body part 85*a* includes a side surface 85*c* arranged on the tape inner side along the tape length direction and an inclined surface 85*d* corresponding to an oblique side of a right-angled triangle. An opposed end (corner) 85*e* corresponding to a vertex of a right-angled triangle is arranged at an end of the inclined surface 85*d* on the side opposite to the first separable interfitting part 70. Further, a crossing portion (in other words, the back end of the side surface 85*c*) of the side surface 85*c* and the inclined surface 85*d* is arranged on the backward side from the opposed end 85*e* and is formed in a curved surface shape like chamfered.

If the first dimension A to the sixth dimension F are defined like in the first embodiment, the protruding part 85 in the third embodiment is formed so as to have the relationship of first dimension A<third dimension C<second dimension B. Also, the second separable interfitting part 80 in the third embodiment is formed so as to have the relationship of fourth dimension D+fifth dimension E>sixth dimension F. Further in this case, the protruding part 85 in the third embodiment is preferably formed so as to have the relationship of first dimension A+fifth dimension E>sixth dimension F.

The insertion recess 86 in the second separable interfitting part 80 is recessed to the lower surface side at the front end of the second body part 81 so as to correspond to the auxiliary engaging part 75 of the first separable interfitting part 70. The auxiliary engaging part 75 of the first separable interfitting part 70 is inserted into the insertion recess 86 when the right and left element rows 64 are interlocked. Accordingly, when the right and left element rows 64 are interlocked, relative positions of the first separable interfitting part 70 and the second separable interfitting part 80 are prevented from being shifted in the up and down direction.

The rib portion 87 in the second separable interfitting part 80 is arranged on the upper surface side and the lower surface side of the second body part 81 to reinforce the second separable interfitting part 80 and also to make it easier to grip the second separable interfitting part 80. In this case, the space between the protuberance 84 and the rib portion 87 of the second separable interfitting part 80 becomes a passage through which the upper and lower flanges 95 of the second slider 90*b* pass when the second slider 90*b* slides.

The first and second sliders 90*a*, 90*b* in the third embodiment each have a slider body 91 and a tab. The slider body 91 includes an upper blade, a lower blade, a guide post 94 connecting the upper and lower blades at the front end, the upper and lower flanges 95 arranged in a direction perpendicular to the upper and lower blades from a right and left side edge of the upper and lower blades, a tab attaching post installed upright on the upper surface of the upper blade, and a locking pawl 97 arranged on the upper blade. The tab is rotatably attached to the tab attaching post.

In this case, a tape insertion gap allowing the fastener tape 63 to be inserted through is formed between the upper and lower flanges 95 at a right and left side edge of the slider body 91 and the interval of the tape insertion gap is set smaller than the thickness dimension of the slider-holding part 72 in the first separable interfitting part 70 and the thickness dimension of the second engaging/releasing part 82*b* in the second separable interfitting part 80.

A posterior orifice is arranged at the back end of the first and second sliders 90*a*, 90*b* and a shoulder is arranged at the front end of the first and second sliders 90*a*, 90*b* and on both of right and left sides of the guide post 94. An element guide passage of the first and second sliders 90*a*, 90*b* is formed by being enclosed with the upper and lower blades and upper and lower flanges 95 and arranged in a substantially Y shape so that the posterior orifice and the right and left shoulders of the first and second sliders 90*a*, 90*b* are communicatively connected. In the third embodiment, the first slider 90*a* and the second slider 90*b* are mounted on the element row 64 in an orientation in which the posterior orifices face each other.

Further in the third embodiment, the interval of the tape insertion gap in the first slider 90*a* and the interval of the tape insertion gap in the second slider 90*b* are set to mutually different sizes. More specifically, the interval of the tape insertion gap in the first slider 90*a* is set larger than the interval of the tape insertion gap in the second slider 90*b*.

Also, the interval of the tape insertion gap in the second slider 90*b* is set larger than the thickness dimension of the second body part 81 in the second separable interfitting part 80 and smaller than the thickness dimension of the first engaging/releasing part 82*a* and the protuberance 84 in the second separable interfitting part 80.

On the other hand, the interval of the tape insertion gap in the first slider 90*a* is set larger than the thickness dimension of the second body part 81 and the protuberance 84 in the second separable interfitting part 80 and smaller than the thickness dimension of the first engaging/releasing part 82*a* in the second separable interfitting part 80.

Then, with the interval of the tape insertion gap of the first and second sliders 90*a*, 90*b* having the above relationship with the second separable interfitting part 80, the second separable interfitting part 80 can smoothly be inserted into the first and second sliders 90*a*, 90*b* through the interval of the tape insertion gap of the first and second sliders 90*a*, 90*b*.

Figure 15:
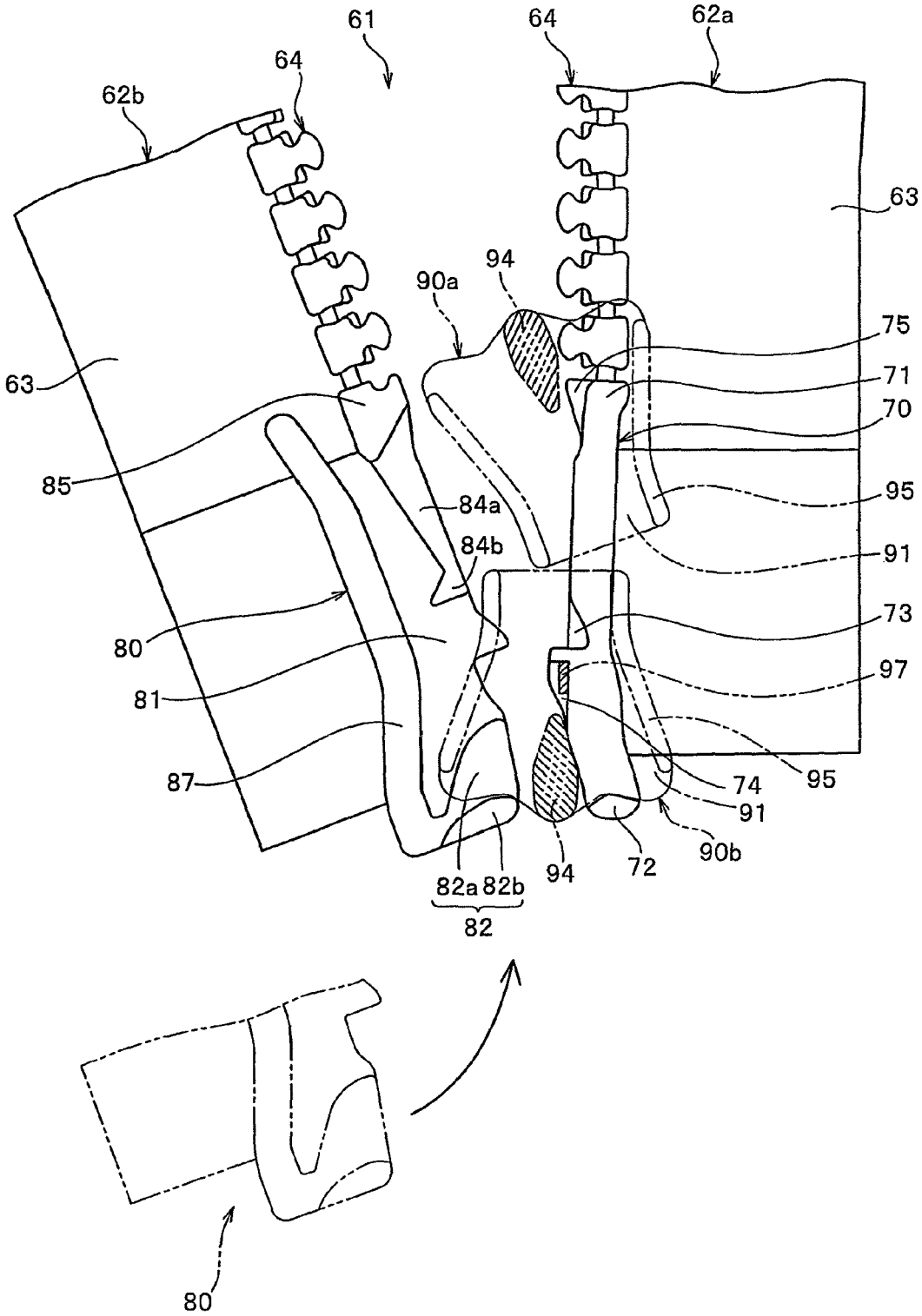
FIG. 15 is an explanatory view illustrating an operation to engage a slider-engaging/releasing part of the second separable interfitting part in the slide fastener with a shoulder-side end of a first slider.
Figure 16:
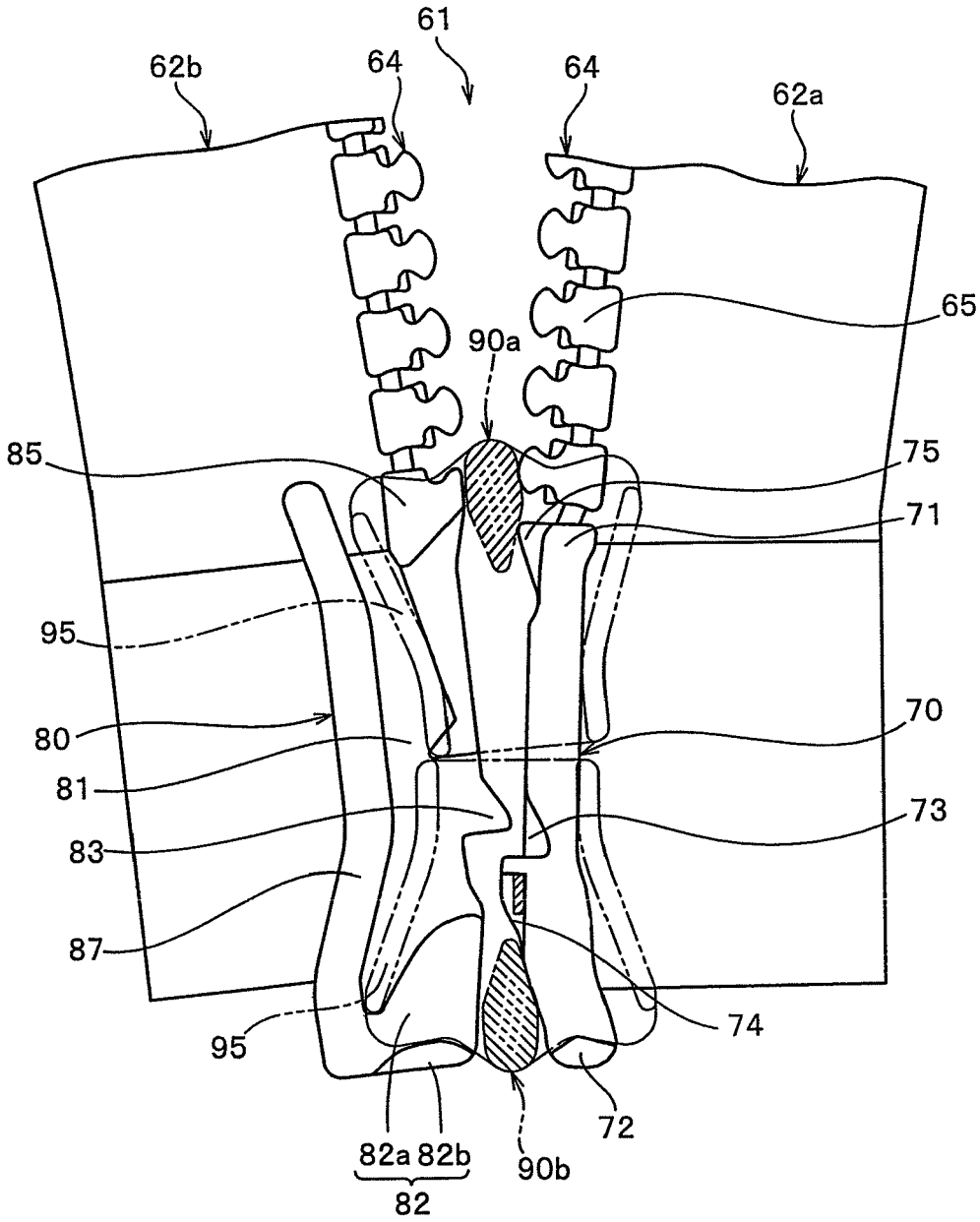
FIG. 16 is a schematic diagram showing a state in which the second separable interfitting part is inserted into first and second sliders.
Figure 17:
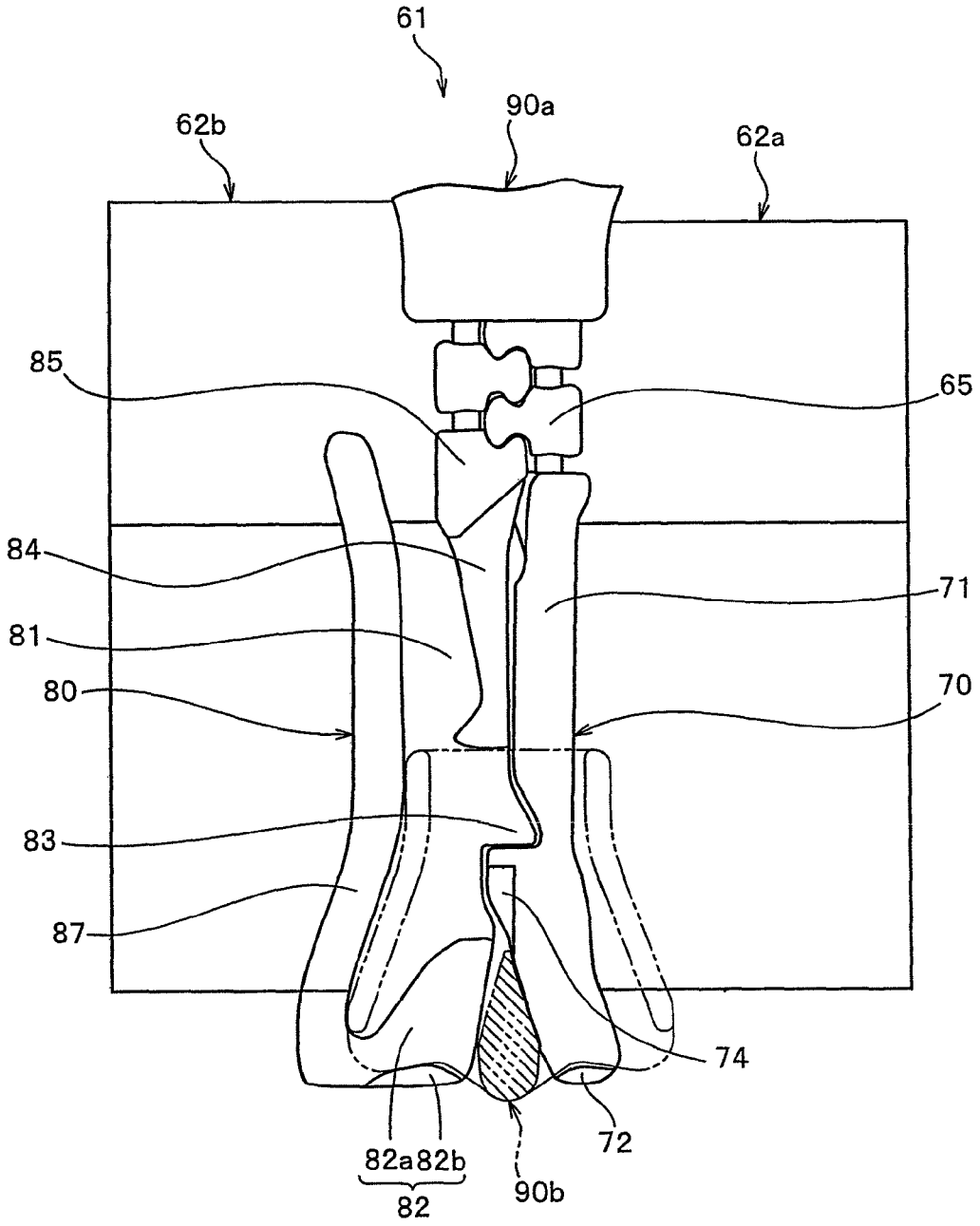
FIG. 17 is a schematic diagram showing a state in which right and left element rows are interlocked by sliding the second slider.
Figure 18:
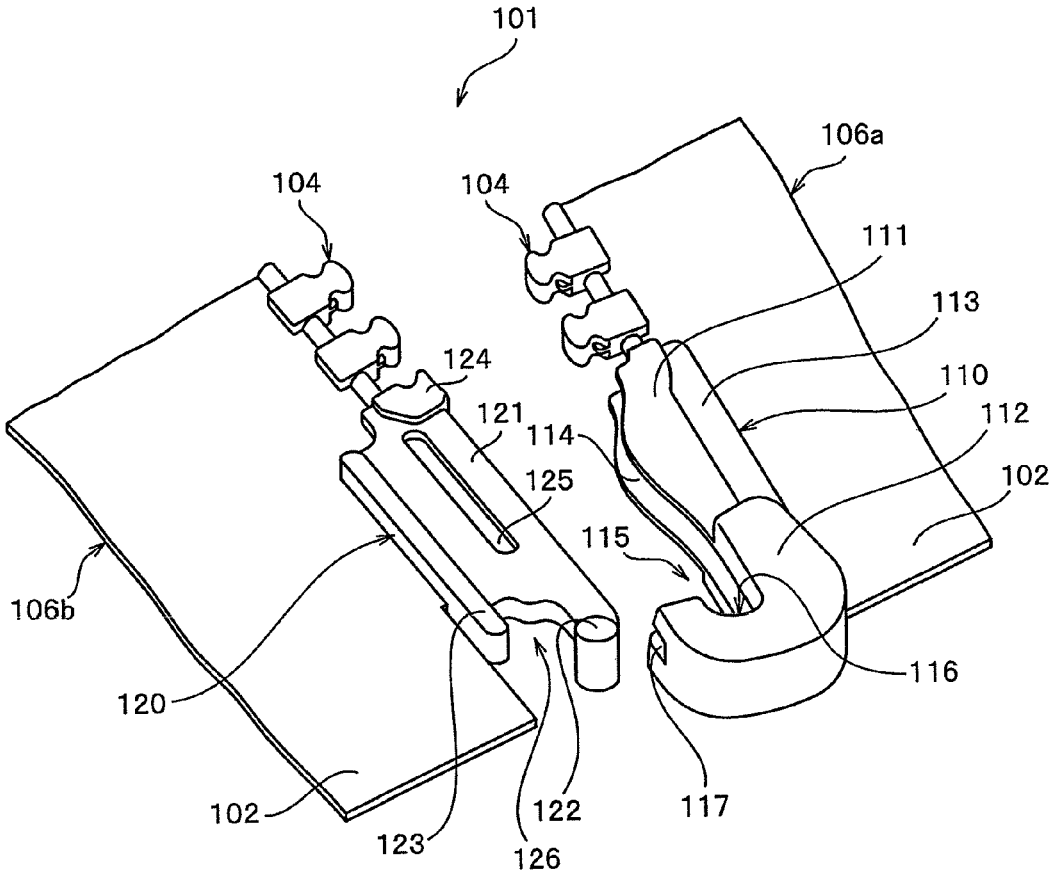
FIG. 18 is a perspective view showing the first and second separable interfitting parts in a conventional slide fastener.
Figure 19:
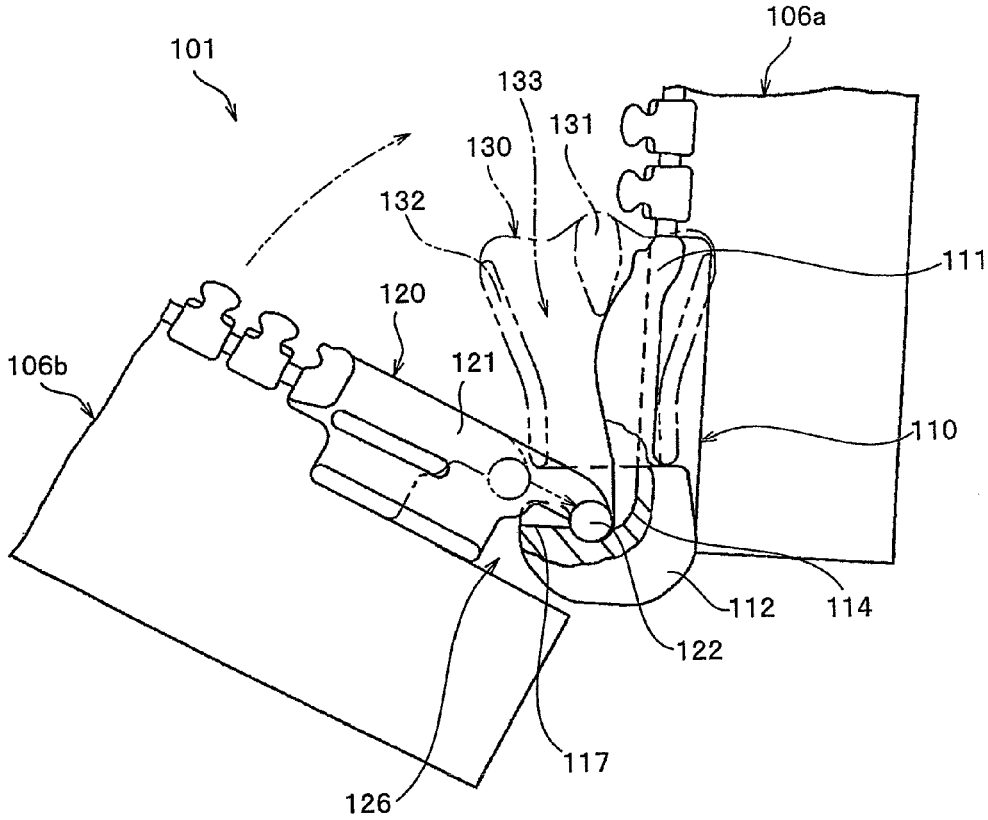
FIG. 19 is an explanatory view schematically illustrating a first engaging operation in the conventional slide fastener.
Figure 20:
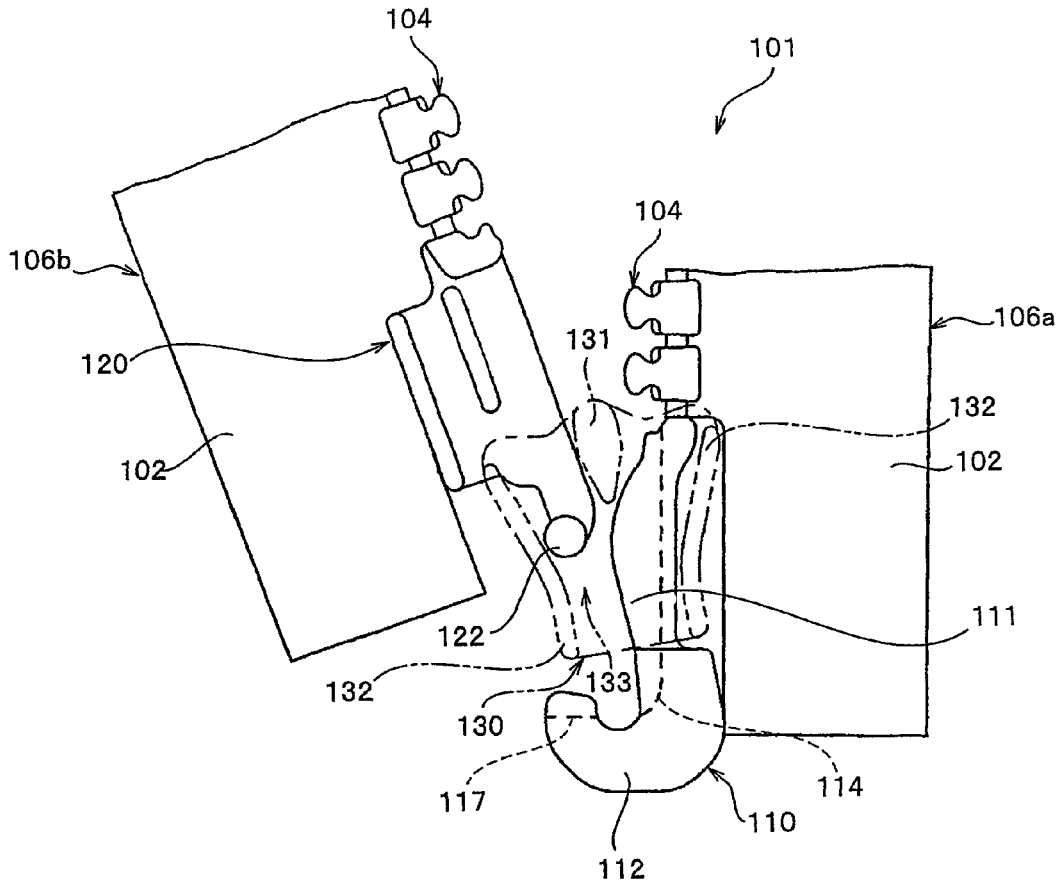
FIG. 20 is an explanatory view schematically illustrating a second engaging operation in the conventional slide fastener.

Next, a case when the slide fastener 61 according to the third embodiment having the above configuration is closed by interlocking the right and left element rows 64 from a state in which the first and second fastener stringers 62*a*, 62*b* are separated will be described with reference to FIGS. 15 to 17. In FIGS. 15 to 17, the first and second sliders 90*a*, 90*b* are shown by virtual lines to make it easier to understand the relationship between the first and second separable interfitting parts 70, 80.

First, the first slider 90*a* and the second slider 90*b* are slid backward along the element row 64 of the first fastener stringer 62*a*. At this point, the second slider 90*b* is moved to the position of the sliding end where the shoulder-side end of the upper and lower blades comes into contact with the slider-holding part 72 of the first separable interfitting part 70 and the first slider 90*a* is moved to the position of the sliding end where the first slider 90*a* comes into contact with the second slider 90*b*. Accordingly, the first and second sliders 90*a*, 90*b* can be held on the slider-holding part 72.

Further, the second slider 90*b* having moved to the sliding end causes the locking pawl 97 of the second slider 90*b* to protrude into the element guide passage to accommodate the locking pawl 97 in the accommodating recess 74 of the first separable interfitting part 70. Accordingly, the stopped state of the second slider 90*b* is held and the second slider 90*b* is temporarily fixed.

In a state in which the first and second sliders 90*a*, 90*b* are held in the position of the sliding end as described above, as shown in FIG. 15, the second separable interfitting part 80 of the second fastener stringer 62*b* is brought closer from the diagonally left rear of the second slider 90*b*. Further, the second body part 81 of the second separable interfitting part 80 is inserted into the element guide passage of the first and second sliders 90*a*, 90*b* through the tape insertion gap of the second slider 90*b* and also the second engaging/releasing part 82*b* of the second separable interfitting part 80 is engaged (hooked) with shoulder-side edges of the upper and lower blades of the second slider 90*b*. Accordingly, the second separable interfitting part 80 can be aligned to a predetermined position with respect to the first separable interfitting part 70.

Next, the second separable interfitting part 80 engaged with the second slider 90*b* is rotated clockwise (insertion direction) when viewed from the front side by using a portion where the second engaging/releasing part 82*b* and the second slider 90*b* are in contact as an axis. At this point, the thickness dimension of the second body part 81 inserted into the second slider 90*b* of the second separable interfitting part 80 is set smaller than the interval of the tape insertion gap of the second slider 90*b* and the thickness dimension of the protuberance 84 inserted into the first slider 90*a* of the second separable interfitting part 80 is set smaller than the interval of the tape insertion gap of the first slider 90*a*.

Therefore, by rotating the second separable interfitting part 80 clockwise (insertion direction), as shown in FIG. 16, the shoulder-side end of the upper and lower flanges 95 of the second slider 90*b* can be caused to engage with the first engaging/releasing part 82*a* of the second separable interfitting part 80 and also the second separable interfitting part 80 can easily be inserted into the element guide passage through the tape insertion gap of the first and second sliders 90*a*, 90*b*.

Also in this case, the first and second sliders 90*a*, 90*b* are held by the sliding end on the side of the first separable interfitting part 70 and thus, when the second separable interfitting part 80 is rotated to be inserted into the element guide passage of the first and second sliders 90*a*, 90*b*, the protruding part 85 of the second separable interfitting part 80 can be inserted into the element guide passage from the shoulder of the first slider 90*a*. With the protruding part 85 being inserted into the element guide passage of the first slider 90*a* in this manner, the second separable interfitting part 80 is positioned to a normal position allowing the right and left element rows 64 to be interlocked properly with respect to the first separable interfitting part 70.

After the second separable interfitting part 80 being positioned to a normal position, the first slider 90*a* is slid upward in the closing direction. At this point, in the slide fastener 61 in the third embodiment, the protruding part 85 satisfies, as described above, the relationship of first dimension A<third dimension C and also the orientation of the first dimension A and that of the third dimension C when the protruding part 85 passes between the guide post 94 and the flange 95 of the first slider 90*a* can be made substantially parallel.

Thus, the protruding part 85 can smoothly be inserted through between the guide post 94 and the flange 95 of the first slider 90*a* without being caught by the first slider 90*a*. Accordingly, the engaging height 83 of the second separable interfitting part 80 can be inserted into the engaging recess 73 of the first separable interfitting part 70 to be engaged there and the right and left element rows 64 can be introduced into the element guide passage from the shoulder of the first slider 90*a* to be interlocked and therefore, the slide fastener 61 can be closed smoothly.

When the first and second fastener stringers 62*a*, 62*b* are in a closed state, the first engaging/releasing part 82*a* of the second separable interfitting part 80 is engaged with the upper and lower flanges 95 of the second slider 90*b* and thus, the second separable interfitting part 80 can be prevented from getting out of the second slider 90*b*. Accordingly, even if the first and second fastener stringers 62*a*, 62*b* are subjected to a horizontal pulling force while, for example, the second slider 90*b* is held by the first separable interfitting part 70, the first and second separable interfitting parts 70, 80 will not get out of the second slider 90*b* so that the right and left element rows 64 can be prevented from separating from the back end side.

When the first and second fastener stringers 62*a*, 62*b* are in a closed state, the right and left element rows 64 can easily be separated from the back end side by sliding the second slider 90*b* held on the slider-holding part 72 forward.

On the other hand, in the slide fastener 61 in the third embodiment, the second separable interfitting part 80 may be held in an abnormal position deviating from the normal position with respect to the first separable interfitting part 70 if, when, for example, the second separable interfitting part 80 is positioned with respect to the first separable interfitting part 70, the second separable interfitting part 80 is brought closer to the first slider 90*a* from the diagonally left front and the protruding part 85 is inserted into the element guide passage from the shoulder of the first slider 90*a* without the second engaging/releasing part 82*b* of the second separable interfitting part 80 being engaged with the second slider 90*b*.

Thus, when the second separable interfitting part 80 is held in an abnormal position, the protruding part 85 in the slide fastener 61 according to the third embodiment satisfies, as described above, the relationship of third dimension C<second dimension B and thus, even if an attempt is made to slide the first slider 90*a* in the closing direction after the protruding part 85 of the second separable interfitting part 80 being inserted into the element guide passage of the first slider 90*a*, the protruding part 85 comes into contact with both the guide post 94 and the flange 95 of the first slider 90*a* and is caught so that sliding of the first slider 90*a* can be prevented.

Particularly in this case, with the protruding part 85 being inserted into the element guide passage of the first slider 90*a* in a posture making the orientation of the second dimension B and that of the third dimension C substantially parallel, the protruding part 85 reliably comes into contact with both the guide post 94 and the flange 95 of the first slider 90*a* so that the first slider 90*a* is prevented from sliding in the closing direction.

Accordingly, when the second separable interfitting part 80 is held in an abnormal position, the user of the slide fastener 61 cannot erroneously slide the first slider 90*a* in the fastener closing direction so that incorrect interlocking of the right and left element rows 64 can reliably be prevented.

DESCRIPTION OF REFERENCE NUMERALS

1 Slide fastener
2*a* First fastener stringer
2*b* Second fastener stringer
3 Fastener tape
3*a* Core thread
4 Element row
5 Fastener element
5*a* Body
5*b* Neck
5*c* Coupling head
5*d* Shoulder
5*e* Fin portion
6 Slide fastener
10 First separable interfitting part
11 Slider-holding part
11*a* Inner-side edge
11*b* Opposite-side edge
12 Pivotal stopping part
12*a* Outer circumferential surface
12*b* Inner circumferential surface
13 Reinforcing part
14 Concave groove
15 Stepped portion
16 Pivotal movement space
17 Dent
20 Second separable interfitting part
21 Body part
22 Pivotal stopped part
23 Projected rim
24 Protruding part
24*a* Protruding body part
24*b* Interlocking part
24*c* Side surface
24*d* Inclined surface
24*e* Opposed end (corner)
24*f* First recess
24*g* Second recess
30 Slider
31 Slider body
32 Upper blade
33 Lower blade
34 Guide post
35 Flange
36 Tab attaching post
37 Locking pawl
38 Element guide passage
40 Second separable interfitting part
44 Protruding part
45 Second separable interfitting part
49 Protruding part
49*c* Side surface
49*e* Opposed end (corner)
49*h* Opposed-side surface
50 First separable interfitting part
51 Slider-holding part
51*c* Notch portion
52 Pivotal stopping part
52*b* Inner circumferential surface
53 Reinforcing part
54 Concave groove
55 Stepped portion
56 Pivotal movement space
58 Swelling portion
59 Mark
61 Slide fastener
62*a* First fastener stringer
62*b* Second fastener stringer
63 Fastener tape
63*a* Core thread
64 Element row
65 Fastener element
66 Reinforcing part
70 First separable interfitting part
71 First body part
72 Slider-holding part
73 Engaging recess
73*a* Wall surface
74 Accommodating recess
74*a* Wall surface
75 Auxiliary engaging part
80 Second separable interfitting part
81 Second body part
82 Slider-engaging/releasing part
82*a* First engaging/releasing part
82*b* Second engaging/releasing part
82*c* Insertion groove
83 Engaging height
84 Protuberance
84*a* Removal stop protuberance
84*b* Position-holding protuberance
85 Protruding part
85*a* Protruding body part
85*b* Interlocking part
85*c* Side surface
85*d* Inclined surface
85*e* Opposed end (corner)
86 Insertion recess
87 Rib portion
90*a* First slider
90*b* Second slider
91 Slider body
94 Guide post
95 Flange
97 Locking pawl

The invention claimed is:

1. A slide fastener with first and second separable interfitting parts having a pair of first and second fastener stringers in which an element row is formed in right and left fastener tapes, one of the first and second separable interfitting parts is fixed to one end of the element row in the first fastener stringer and another one of the first and second separable interfitting parts is fixed to one end of the element row in the second fastener stringer, and a slider slidably attached along the element row of the first fastener stringer, wherein the slider includes a guide post, upper and lower blades connected to the guide post, a flange arranged at right and left side edges of at least one of the upper and lower blades, and a tape insertion gap formed at right and left side edges of the slider, the first separable interfitting part includes a slider-holding part that holds the slider on a sliding end, and the second separable interfitting part is configured to be insertable/removable into/from the slider held on the slider-holding part in a tape width direction through the tape insertion gap, wherein the second separable interfitting part includes a body part in a thin-plate shape fixed to the fastener tape and a protruding part arranged at an end on a side of the element row of the body part and formed thicker than the body part, the protruding part includes an opposed end arranged on the side opposite to the first separable interfitting part and a side surface arranged on the opposite side to the side opposite to the first separable interfitting part, and a dimension of the protruding part in the tape width direction is defined as a first dimension A, a dimension between a back end on the opposite side of the side of the element row on the side surface of the protruding part and the opposed end on the side opposite to the first separable interfitting part is defined as a second dimension B, and a dimension equal to an interval between the guide post and the flange in an element guide passage on a shoulder side of the slider is defined as a third dimension C, and the protruding part has a relationship of the first dimension A<the third dimension C<the second dimension B, and when the slider is held on the slider-holding part and the second separable interfitting part is held in an abnormal position with respect to the first separable interfitting part, the opposed end and the side surface of the protruding part are in contact with the guide post and the flange of the slider respectively, and the back end of the side surface is arranged in a position on a backward side from the opposed end in a tape length direction, and an inclined surface is arranged between the back end of the side surface and the opposed end.

2. A slide fastener with first and second separable interfitting parts having a pair of first and second fastener stringers in which an element row is formed in right and left fastener tapes, one of the first and second separable interfitting parts is fixed to one end of the element row in the first fastener stringer and another one of the first and second separable interfitting parts is fixed to one end of the element row in the second fastener stringer, and a slider slidably attached along the element row of the first fastener stringer, wherein the slider includes a guide post, upper and lower blades connected to the guide post, a flange arranged at right and left side edges of at least one of the upper and lower blades, and a tape insertion gap formed at right and left side edges of the slider, the first separable interfitting part includes a slider-holding part that holds the slider on a sliding end, and the second separable interfitting part is configured to be insertable/removable into/from the slider held on the slider-holding part in a tape width direction through the tape insertion gap, wherein the second separable interfitting part includes a body part in a thin-plate shape fixed to the fastener tape and a protruding part arranged at an end on a side of the element row of the body part and formed thicker than the body part, the protruding part includes an opposed end arranged on the side opposite to the first separable interfitting part and a side surface arranged on the opposite side to the side opposite to the first separable interfitting part, and a dimension of the protruding part in the tape width direction is defined as a first dimension A, a dimension between a back end on the opposite side of the side of the element row on the side surface of the protruding part and the opposed end on the side opposite to the first separable interfitting part is defined as a second dimension B, and a dimension equal to an interval between the guide post and the flange in an element guide passage on a shoulder side of the slider is defined as a third dimension C, and the protruding part has a relationship of the first dimension A<the third dimension C<the second dimension B, and when the slider is held on the slider-holding part and the second separable interfitting part is held in a normal position with respect to the first separable interfitting part, the protruding part is in contact with the guide post or the flange, and the back end of the side surface is arranged in a position on a backward side from the opposed end in a tape length direction and an inclined surface is arranged between the back end of the side surface and the opposed end.

* * * * *

UNITED STATES PATENT AND TRADEMARK OFFICE

CERTIFICATE OF CORRECTION

PATENT NO. : 8,910,352 B2
APPLICATION NO. : 13/702104
DATED : December 16, 2014
INVENTOR(S) : Jiro Nozaki et al.

It is certified that error appears in the above-identified patent and that said Letters Patent is hereby corrected as shown below:

In the Specification

In column 3, line 1, after "110" insert -- to --.

In column 6, line 2, after "on" delete "the".

In column 20, line 36, after "row" insert -- 64 --.

In column 21, line 41, delete "backside" and insert -- back side --, therefor.

In column 22, line 39, delete "engagable" and insert -- engageable --, therefor.

Signed and Sealed this
Twenty-first Day of April, 2015

Michelle K. Lee

Michelle K. Lee
*Director of the United States Patent and Trademark Office*